US008959814B2

(12) United States Patent
Cook

(10) Patent No.: US 8,959,814 B2
(45) Date of Patent: Feb. 24, 2015

(54) POSTER CLAMP, AND SYSTEM AND METHOD USING SAME

(75) Inventor: Sam Kimber Ross Cook, Oxfordshire (GB)

(73) Assignee: Urban Storm Limited, London (GB)

( * ) Notice: Subject to any disclaimer, the term of this patent is extended or adjusted under 35 U.S.C. 154(b) by 578 days.

(21) Appl. No.: 13/122,265

(22) PCT Filed: Sep. 21, 2009

(86) PCT No.: PCT/GB2009/002250

§ 371 (c)(1),
(2), (4) Date: Jun. 8, 2011

(87) PCT Pub. No.: WO2010/038003

PCT Pub. Date: Apr. 8, 2010

(65) Prior Publication Data

US 2011/0314712 A1 Dec. 29, 2011

(30) Foreign Application Priority Data

Oct. 2, 2008 (GB) ..... 0818052.3
Jan. 22, 2009 (GB) ..... 0901077.8

(51) Int. Cl.
*G09F 7/00* (2006.01)
*G09F 15/00* (2006.01)

(52) U.S. Cl.
CPC ..... *G09F 15/0018* (2013.01); *G09F 15/0025* (2013.01)
USPC ..... 40/611.12; 40/603; 24/516

(58) Field of Classification Search
USPC ..... 40/611.12, 603, 604, 606.11; 38/12, 38/102; 24/516, 504, 540, 541, 498, 503
See application file for complete search history.

(56) References Cited

U.S. PATENT DOCUMENTS

| | | | | |
|---|---|---|---|---|
| 514,454 | A * | 2/1894 | Saxton et al. | 24/337 |
| 1,472,471 | A * | 10/1923 | Hope | 24/457 |
| 2,622,300 | A | 12/1952 | Marziani | |
| 3,136,020 | A * | 6/1964 | Baker | 24/498 |
| 4,005,510 | A * | 2/1977 | Noda | 24/504 |
| 4,084,299 | A * | 4/1978 | Noda | 24/504 |
| 4,086,686 | A * | 5/1978 | Takabayashi | 24/504 |

(Continued)

FOREIGN PATENT DOCUMENTS

| | | |
|---|---|---|
| CA | 2484135 A1 | 4/2006 |
| DE | 29506718 U1 | 9/1995 |

(Continued)

OTHER PUBLICATIONS

International Searching Authority—ISR/Written Opinion for PCT/GB2009/002250, dated Dec. 23, 2009, 18 pages.

(Continued)

*Primary Examiner* — Kristina Junge
(74) *Attorney, Agent, or Firm* — Brian B. Shaw, Esq.; Thomas B. Ryan, Patent Agent; Harter Secrest & Emery LLP

(57) ABSTRACT

A poster clamp (1) comprising first and second members (3, 5), the members (3, 5) comprising first and second gripping surfaces (7), respectively, for gripping opposing sides of a poster or a like, and a poster mounting system comprising a hoarding (208) and a plurality of such clamps (1), and a wire (210) on which the clamps (1) are to be mounted for tightening a poster within the frame of the hoarding (208).

19 Claims, 26 Drawing Sheets

(56) References Cited

U.S. PATENT DOCUMENTS

| | | | | |
|---|---|---|---|---|
| 5,913,478 | A | 6/1999 | Ochsman | |
| 6,098,859 | A * | 8/2000 | Bortner | 224/272 |
| 6,260,244 | B1 * | 7/2001 | Noda | 24/499 |
| 6,416,028 | B1 | 7/2002 | Miller et al. | |
| 6,516,500 | B2 * | 2/2003 | Ogino et al. | 24/504 |
| 6,698,071 | B1 | 3/2004 | Greer, Jr. et al. | |
| 7,174,607 | B1 * | 2/2007 | Buettell | 24/504 |
| 7,896,522 | B2 | 3/2011 | Heller et al. | |
| 8,393,101 | B2 * | 3/2013 | Knight et al. | 40/611.12 |
| 2001/0023549 | A1 | 9/2001 | Geiberger et al. | |
| 2002/0000027 | A1 | 1/2002 | Andersen et al. | |
| 2003/0200685 | A1 | 10/2003 | Gibb | |
| 2007/0247860 | A1 | 10/2007 | Franklin et al. | |
| 2008/0104805 | A1 | 5/2008 | Cameron | |
| 2008/0209696 | A1 | 9/2008 | Lewis | |
| 2008/0250613 | A1 | 10/2008 | Franklin et al. | |
| 2009/0019750 | A1 | 1/2009 | Gibb et al. | |
| 2009/0038124 | A1 | 2/2009 | Franklin et al. | |
| 2009/0229085 | A1 | 9/2009 | Franklin et al. | |
| 2012/0066945 | A1 * | 3/2012 | Cook et al. | 40/541 |
| 2012/0159822 | A1 | 6/2012 | Gibb et al. | |

FOREIGN PATENT DOCUMENTS

| | | | |
|---|---|---|---|
| GB | 2017586 | A | 10/1979 |
| GB | 2295629 | A | 6/1996 |
| JP | 2001112516 | A | 4/2001 |
| WO | 00/11352 | | 3/2000 |
| WO | 03/098055 | A1 | 11/2003 |
| WO | 2007/092605 | A2 | 8/2007 |
| WO | 2007/124487 | A2 | 11/2007 |
| WO | 2008/128247 | A1 | 10/2008 |
| WO | 2009/012318 | A1 | 1/2009 |
| WO | 2009/083646 | A1 | 7/2009 |
| WO | 2009/105644 | A1 | 8/2009 |
| WO | 2012/087407 | A1 | 6/2012 |

OTHER PUBLICATIONS

UKIPO Search Report dated Feb. 5, 2010 (2 pages) in corresponding UK Patent Application No. GB 0918702.2.

UKIPO Search Report dated May 11, 2010 (3 pages) in corresponding UK Patent Application No. GB 0901077.8.

UKIPO Search Report dated May 29, 2009 (2 pages) in corresponding UK Patent Application No. GB0901077.8.

* cited by examiner

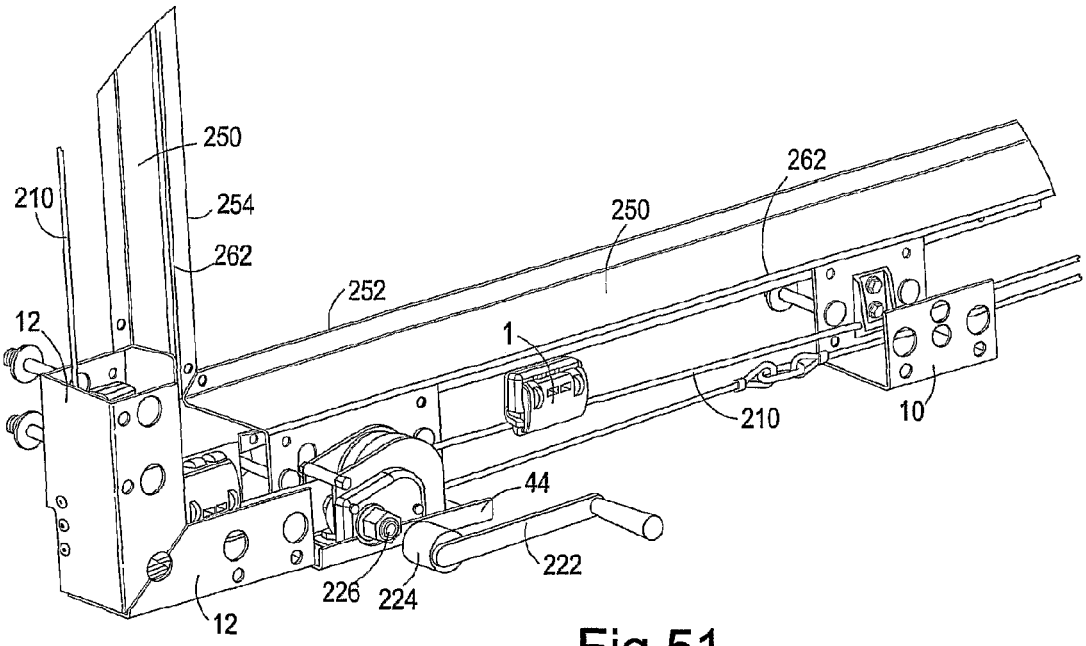
Fig.51
Fig.52
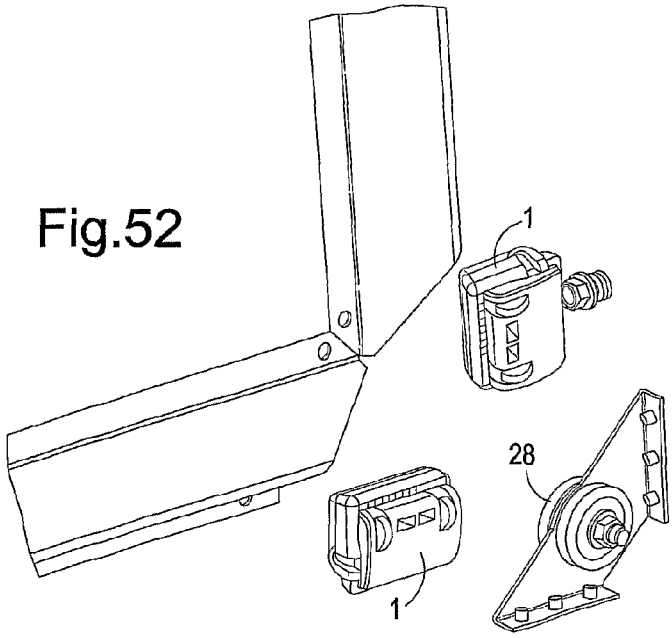

POSTER CLAMP, AND SYSTEM AND METHOD USING SAME

FIELD OF THE INVENTION

The present invention relates to a poster clamp, a system for mounting a poster using such a clamp and a method of mounting a poster on a mount, such as a billboard or a hoarding or a display panel, using such a clamp.

BACKGROUND OF THE INVENTION

Posters, such as found on advertising hoardings, have traditionally been held in place by an adhesive rolled on to the hoarding, followed by the poster which is formed of a number of sections of paper, canvas, fabric, bunting, cloth, tarpaulin or textile or the like. In order to mount posters such as banners, billboards, placards, signs, notices or other advertisements, or the like, it is necessary for the person mounting these to place each part in the correct place relative to the other parts so that the poster, as a whole, shows the desired imagery. Once the poster is no longer to be displayed, a new advertisement or the like is generally placed on top of the original in the same way, or the old poster may be removed and replaced with the new poster. Further, access equipment such as ladders, cranes, cherry pickers, scissor lifts or scaffold towers or the like are generally required.

The present invention seeks to overcome or ameliorate at least one of the disadvantages of the prior art.

SUMMARY OF INVENTION

According to a first aspect of the invention there is provided a poster clamp according to claim 1. One or more of these poster clamps can be used to attach a fabric poster to a hoarding without the need for adhesive, or pockets, eyelets or the like.

Further, a poster can be released from the clamp in order for it to be reused, changed or removed.

The poster clamp comprises first and second members, the members comprising first and second gripping surfaces, respectively, for gripping opposing sides of a poster or the like.

In an alternative arrangement, the poster clamp comprises first and second members, the members comprising first and second surfaces, respectively, for gripping opposing sides of a poster or the like, the two members being arranged for pivotal movement with respect for one another and having a clamping device for clamping the two surfaces towards one another.

Either one or both of the surfaces may be gripping surfaces, i.e. surfaces with surface features to enhance grip.

In certain embodiments, the members further comprise first and second abutting surfaces, respectively, the abutting surfaces being configured for mutual abutment when the first and second gripping surfaces are opposed and abutting.

The abutting surfaces may be flat or curved. They may also be defined by axle(s)/bearing(s) of one or more hinge, i.e. the two members may be hingedly connected together.

The clamp may comprise a first retaining portion on the first member, and a second retaining portion on the second member for engaging with the first retaining portion of the first member. These may lock or hold the two members in fixed positions relative to one another position, usually while the abutting and gripping surfaces are in mutual respective abutment, or may simply serve to hold the two components in a fully or partially assembled state.

At least one of the first and second retaining portions may be deformable for allowing disengagement of the first and second retaining portions and the unlocking or disassembly of the two members.

The second retaining portion may comprise a tongue extending away from the second gripping surface.

The first retaining portion may comprise a cross-member extending transversely across the first member to engage with the tongue.

The tongue of the second retaining portion may comprise a serrated surface, which is arranged to engage with the cross-member of the first retaining portion.

The tongue may comprise a detent to engage releasably with the cross-member.

The tongue may be resiliently connected to the body of the second member, deformation of the tongue releasing engagement of the tongue with the first retaining portion.

The tongue may comprise a recess and the cross member may comprise two engaging regions, the detent engaging with the first engaging region to retain the first and second members in an engaged configuration in which the first and second members cannot be separated without deformation of the tongue and a poster may be placed between the gripping surfaces, and the detent engaging with the second engaging portion to lock the first and second members in a locked configuration in which the members cannot be unlocked without deformation of the tongue, and a poster placed between the gripping surfaces is gripped and held therebetween.

A tongue might instead be provided, however, for a separate purpose: to bias the two gripping surfaces apart for providing default relative orientations or default relative positions, for the first and second members, i.e. until clamped shut by its given closure mechanism, that allows an edge of a poster to be inserted into the clamp between the two gripping surfaces. The gripping surfaces and first and second members therefore present an open jaw for receiving a poster's edge.

In place of a tongue and cross member, a first retaining portion may be provided as one or more post, and the second retaining portion may be provided as one or more hole for receiving the or each post. This is a preferred arrangement.

Preferably neither the hole's shape nor the post's shape are readily deformable in use.

In this preferred arrangement, a third member is also provided. The third member is for securing or latching or hooking onto to the post or posts. The third member prevents an inadvertent disassembly of the first and second components. It can also be for biasing the first and second gripping surfaces together.

The first and second members may be arranged to slide relative to one another, with the abutting surfaces of the first and second members abutting one another. Preferably, however, the two members pivot relative to one another for making the two gripping surfaces grip a poster.

The first and second members are preferably separable. Likewise the third member, where provided, is preferably separable from the first and second members.

One of the first and second members may comprise one or more projection extending away from the body of that member in the direction in which the gripping surface of that member faces.

The other of the first and second members may comprise one or more risers extending away from the body of that member in the direction in which the gripping surface of that member faces. The risers may be the above mentioned post or posts. The projection is then replaced with the above mentioned hole or holes, or some other post receiving means.

When the projection and the one or more risers are provided, the projection may have a barb at the end distal to the member to which it is attached, the barb extending towards the riser(s). The barb acts to retain, in use, a wire placed transversely between the projection and riser(s).

Projections and/or risers, or even hooked flanges, might instead be provided to extend from the ends or edges of the clamp. They might all be provided on one of the members, or else they may be provided on a selection of the members.

The projections and/or risers, or the hooked flanges, are shaped to allow a wire to be received or retained by them, e.g. by having a barb or the like, or by being hook-shaped. They serve to retain the clamp on the wire, either in a fixed or lateral-movement resisting position or in a manner in which it can slide along the wire.

The shape of the projections, risers or flanges generally include a slot or opening for receiving the wire via a lateral insertion, rather than requiring the end of the wire to be threaded through a hole. This is to allow the clamps to be fitted to a wire that is already mounted onto a poster hoarding. It also allows the potential replacement or removal of the clamps without disassembling the wire (or freeing up an end of the wire) from the hoarding.

In certain arrangements, the clamp is arranged or adapted such that on tensioning of a wire passing transversely between or through the projection and/or risers, or the hooked flanges, the first member is moved relative to the second member. This can be by causing a twisting of the clamp, or by having the alignment of the projections and risers suitably positioned on respective first and second members such that they allow a bent wire to pass through the gaps between, under or through the projections and risers with little resistance, but making a straight wire encounter resistance to such sliding movement. The movement between the first and second members can be fractional, e.g. less than the width of the grooves in the gripping surfaces, and may create either a reduced transverse distance between the two surfaces or a lateral displacement of the two surfaces. Therefore such movements can serve to alter the relative spacings between the gripping surfaces, or cause the gripping surfaces to embed or otherwise grip into the surface of the poster, either way for increasing the grip of the clamp on a poster, or the like, located between the two gripping surfaces.

In a preferred embodiment, however, the projections or risers, or the hooked flanges, are aligned such that a straight wire can freely slide through the gap defined through or behind or between them. This allows the clamp to self adjust along the wire during the installation of a poster, whereby the poster should automatically lie flat in the finished installation even if the clamps are not located in exactly the correct positions on the poster's edge.

Preferably the clamp comprises the third member. The third member is preferably movable relative to the first and/or second member, and is provided for biasing the two gripping surfaces together. This is preferably achieved by providing the third member with one or more camming surface for pressing against an opposing surface of one of the first and second members. Therefore, the third member, upon moving it relative to that first or second member in a first direction, i.e. towards or into a final clamping position, causes the camming surface to increase its pressure against the opposing surface for either closing the jaw (formed by the two gripping surfaces) or for imposing a clamping force with the jaw, e.g. against the poster, when fitted in the jaw.

In a preferred embodiment, an end part of the movement of the third member into its final clamping position may be an over-centre movement for the cam, i.e. allowing a fractional release of pressure. This will give a positive engagement feedback to the user, and it will also assist the clamp in resisting accidental or inadvertent release of the clamping force against a poster.

Preferably the camming surface, or surfaces, are provided on one or more camming prong, or camming flange. The or each prong or flange extends from an underside of third member, i.e. in use it extends into the clamp. The third member can therefore also take the form of a cover piece for the clamp for presenting a finished external appearance for the clamp in its final use position on the hoarding. That finished external surface can include an area onto which brand identity can be printed or molded.

The back surface of the third member may be shaped to allow it to rest generally parallel to, or closely adjacent to, or against, an outer surface of the second member once moved into its clamping position. This gives the clamp a smaller depth once it is clamping a poster.

Preferably the third member is pivotally mounted onto the first or second member about a first pivot axis, and the camming surface or surfaces is spaced from that pivot axis by a varying radius, i.e. it is on a cam. Therefore, by rotating the third member relative to the rest of the clamp, the second member is biased towards the first member for closing the jaw or increasing a clamping force between the first and second gripping surfaces.

Preferably the third member is pivotally mounted to the first member, with the second member being sandwiched between them.

Preferably the third member is pivotally mounted onto one or more posts that extend up from the first member away from its gripping surface.

Preferably the third member is releasable from the first member. This could allow the clamp to be fully disassembled.

With a removable third member, a range of third members can be provided, each with a different profile for the camming surface, whereby different clamping forces can be provided by the respective third portions to allow for different poster thicknesses to be accommodated—a thicker poster material would require a lower final camming height on the cam (e.g. largest radius from the pivot axis of the third member) than a thin poster in order to provide the same clamping force since the jaws of the clamp would need to move less distance from the open position prior to engaging the two surfaces of the poster. The thickness of the intended poster for any particular third member may be printed on the third member—trying to clamp a poster that is too thick for a particular camming arrangement could lead to a failure of the clamp—the compressive forces with these clamps are very high in order to grip a poster sufficiently tightly to secure the poster to the hoarding during high wind conditions.

Preferably the third member is pivotally connected to the first member at a first pivot axis.

Preferably the first and second members are pivotally connected to one another so as to define a second pivot axis. Preferably that second pivot axis is formed by pairs of apertures and pivot axles in the first and second members. Preferably the axles or apertures have a ramp feature to facilitate assembly of the two components. The ramp may terminate in a manner to resist disassembly, e.g. by having a step for terminating the ramp.

Preferably the apertures are elongated to allow the hinge point to float within the aperture. This allows a wider range of poster thicknesses to be accommodated.

Preferably the first pivot axis extends parallel to the second pivot axis. It also is preferably spaced away from that second pivot axis.

Preferably each gripping surface comprises a plurality of indentations and/or protrusions. Most preferably the surfaces comprise grooves. Those grooves preferably extend generally parallel to one another.

Preferably the grooves extend from one side of the clamp to the other side of the clamp, or at least across the majority of the area therebetween.

Preferably the grooves are straight. However, instead of straight grooves, the grooves may be zig-zagged or curved, or even circular. Combinations of shapes may also be provided, and combinations of grooves, indentation and protrusions might be provided. The gripping surfaces are provided, however, to achieve a good grip on the poster.

Preferably the grooves, indentations and/or protrusions extend across, or cover, the full width of the gripping surface regions of both the first and second members.

Preferably the first and second gripping surfaces intermesh upon clamping them together, whereby a poster, upon compressing the two gripping surfaces onto the poster, will cause the poster to at least partially deflect into the grooves or indentations, or both, so as to assume a corresponding profile to the intermeshing gripping surfaces. This intermeshing, or at least partial intermeshing, provides a more positive and effective grip onto the poster.

Preferably a hole or recess is provided in the third component for receiving a clamp release device, such as a blade or screwdriver. The hole or recess may take the form of a finger grip on a leading edge of the third member, whereby a tool or finger can get a purchase on the third member for unclamping the clamp from a poster's edge. Preferably two holes are provided whereby a two pronged tool can be necessitated. This allows a release accessory to be bundled with the clamp. The present invention therefore also provides, as a separate invention, a poster clamp in combination with a poster clamp release tool, the release tool comprising a member with two prongs at a free end thereof. The clamp may additionally have any of the preceding features.

According to a second aspect of the present invention there is provided a poster mounting system according to claim 16. In such a system, a loop of wire is incorporated into or onto a poster hoarding, or a surround. A poster to be displayed can be attached to the wire, using clamps, as defined above, for engaging the edges of the poster. Most usefully this can be achieved without the loop being opened since the clamps can be hooked onto the wire, rather than needing to be threaded onto the wire via a free end of the wire.

To achieve the clamping of the poster onto the clamps, where the clamps are already on the wire, or to hang the clamps on the wire in the first place, or when they are prefitted onto the poster, rather than onto the wire, the wire is grasped by the user and the hooks, or the like, are engaged onto the wire. For the top wire, or higher side wires, a pole may be used to grasp the wire such that it can be pulled down to the working height or to reach the wire with the clamps for mounting them onto the wire. This invention therefore removes or reduces the need for ladders or cherry pickers.

After connecting the clamps to the poster, and to the wire, as needed in the circumstances, the wire is drawn tight. The poster as a result is then pulled to the outer edge of the hoarding and held in tension.

When the poster is to be removed, the wire loop is loosened for enabling access to all the clamps from ground or standing height level. The poster can then be released from the clamps (if the clamps are to be reused), or the clamps can be released from the wire (if the new poster to be fitted is prefitted with clamps), and a new poster can then be fitted either to the old clamps or to the wire. The cable is then again drawn back tight to complete the installation of the new poster.

The wire can be tensioned using a cable tensioning system, or where two ends are to be tensioned independently, using two tensioning systems. Those systems may use ratchets and levers to allow a sufficient tension to be provided. A winch system, however, is preferred.

Prior to final tensioning, the wire may need to be linked on to bearings or hangers that are evenly spaced around the perimeter of the hoarding using the long pole, which may have a grab end. This is to ensure that there is no droop in the cable when under tension. Alternatively the wire may be pre-threaded around loop bearings from which the wire cannot escape. Such loop bearings, or other bearings that retain (or encapsulate around the wire) are most preferred at least in the corners of the hoarding—cable tension can retain the wire in non-encapsulating bearing members, and re-hooking the wire around the edges of the hoarding, as opposed to at the corners, is relatively simple while the cable is not under tension, so long as the corners are correctly hooked onto the corner bearing members.

According to a third aspect of the invention, there is provided a method of mounting a poster as claimed in claim 17. The method may make use of the system of the second aspect and can make use of one or more poster clamps according to the first aspect of the invention.

According to another aspect of the present invention there is provided a poster mounting system or apparatus comprising a loop or length of wire incorporated into or onto a poster hoarding generally around at least part of its perimeter and a plurality of clamps attached to or attachable to the wire, wherein the clamps are for attaching a poster to be displayed to the wire by simultaneously engaging edges of the poster and being attached to the wire, the wire being in a generally tightened condition, the system or apparatus further comprising a guide frame or guide frame members over which the poster is tightened as the wire is drawn from a slackened condition into a tightened condition. The guide frame (or the frame members) provides an edge for providing a flat finish to the area of the poster lying within the guide frame—the tightening of the clamps onto the edges of the poster, and the tensioning of the poster by the resulting point attachments, can cause the poster to assume a creased or rippled finish, but that creased or rippled finish is flattened by the guide frame, at least for the area of the poster lying within the guide frame, i.e. the area that is viewed from outside the housing.

Preferably the hoarding is square or rectangular, and the guide frame consists of at least four frame members—one for each side, each having a rounded edge over which the poster can be tightened. It is also envisioned that a side may have two or more linearly aligned frame members therealong.

Preferably the guide frame has a generally saw-tooth cross section, the tip defining an edge over which the poster is drawn to taughten it into a flat configuration. That tip is preferably rounded to a radius of not less than 2 mm.

The guide frame generally matches, or is larger than (so as to be covered thereby), the shape of the inner edge of the hoarding's external frame, i.e. the frame that defines the aperture through which the poster is viewed by the public.

Preferably the clamps are in accordance with the clamps defined above.

Preferably there is only a single wire around the hoarding, the wire extending around the frill, or substantially the full, perimeter of the hoarding.

Preferably the hoarding comprises a winch assembly for tightening the wire. Preferably the winch assembly has a removable winch handle.

Preferably the guide frame or frame members have notches therein for accommodating wire guides and wire bearings, or the brackets therefor, since such guides, bearings and brackets therefor will generally be located around the perimeter of the hoarding. In addition, or alternatively, the guide frame or frame members can have an asymmetrical shape in section. Such notches, and such a shape for the section of the guide frame, allow valuable advertising space on the hoarding to be preserved or maximised—minimal (if any) valuable advertising space will be lost between the raised edge of the guide frame and the inner edge of the hoarding's outer frame since the guide frame, or its edge, can be mounted close to the wire. This also ensures that the clamps and the guide frame are hidden behind the outer frame of the hoarding.

These and other preferred features are set out in the dependent claims.

BRIEF DESCRIPTION OF THE DRAWINGS

Embodiments of the present invention will now be described, purely by way of example, with reference to the accompanying drawings in which:—

FIG. 51 shows a first detail of the winch area of the poster mounting system shown in FIG. 50; and FIG. 52 shows a second detail from FIG. 50—the pulley at the opposite side of the bottom of the poster mounting system (with corner bracket and wire removed for clarity).

DETAILED DESCRIPTION OF EMBODIMENTS OF THE INVENTION

Figure 1:
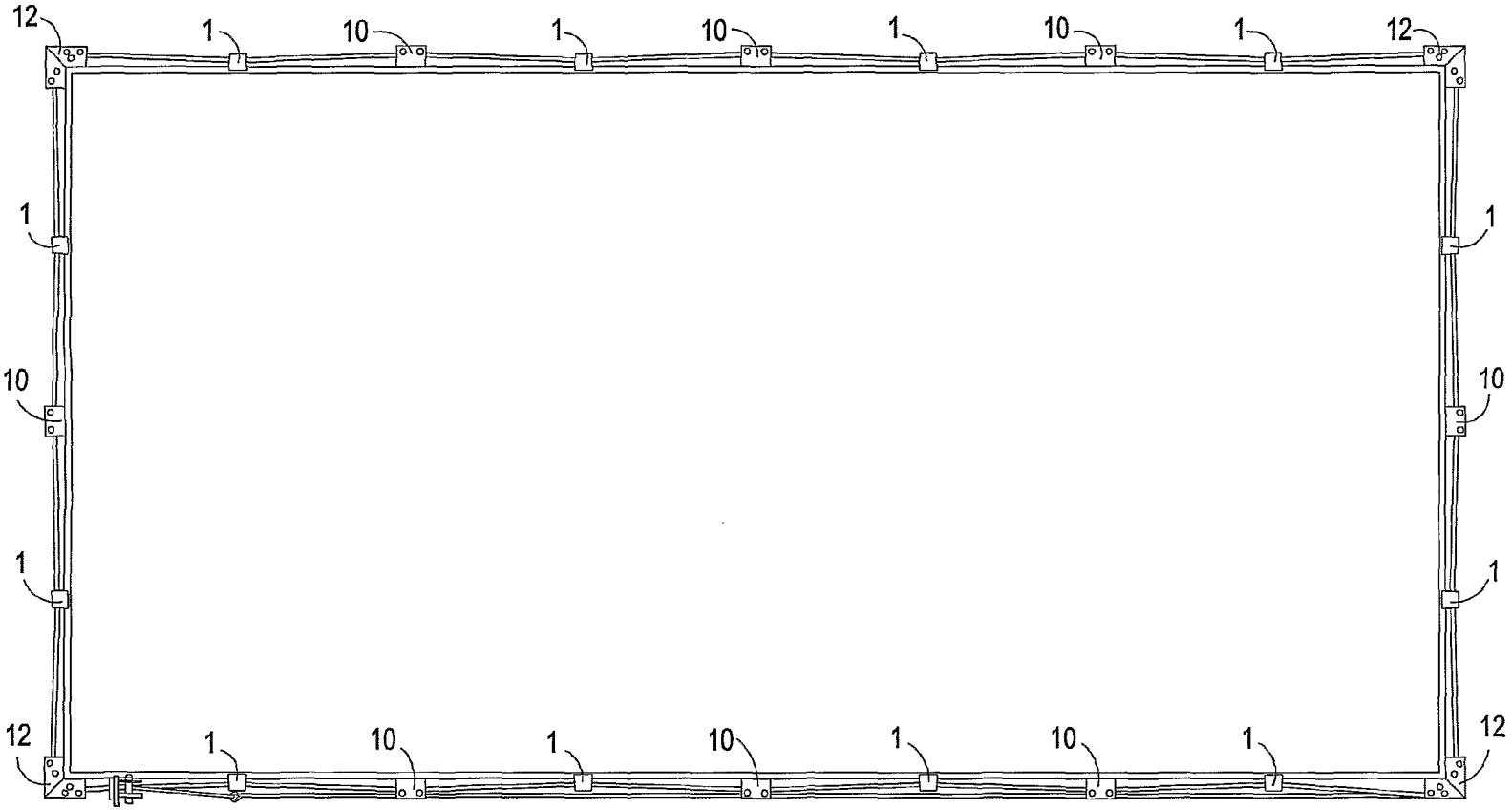
FIG. 1 is a schematic view of a preferred implementation of the invention on a billboard for receiving a poster having dimensions of approximately 6 by 3 meters.

Referring first to FIGS. 1A to 1D, a first poster mounting system 200 and a first poster clamp 1 design is shown. This embodiment is as per the disclosures in GB0818052.3, the whole contents of which are incorporated herein by way of reference.

The system 200 includes a wire 210 (or the like) that is provided in a ring or a loop around the edges of a hoarding 208. The loop or wire 210 can be tightened by a tightening mechanism in this embodiment, two lever-operated ratchets 220.

Figure 1A:
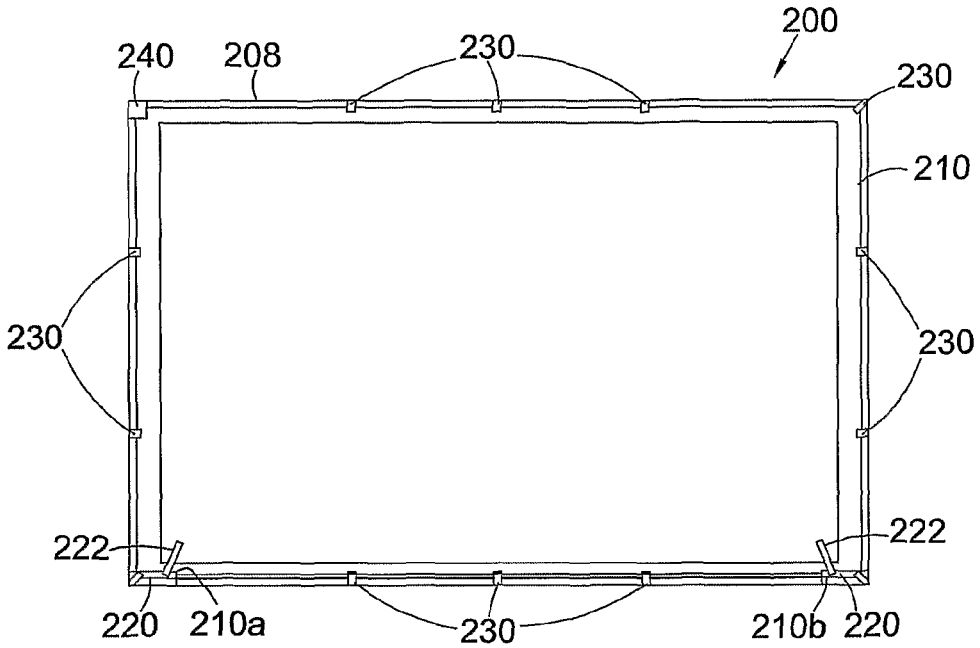
FIG. 1A schematically illustrates an alternative implementation of the present invention.
Figure 1B:
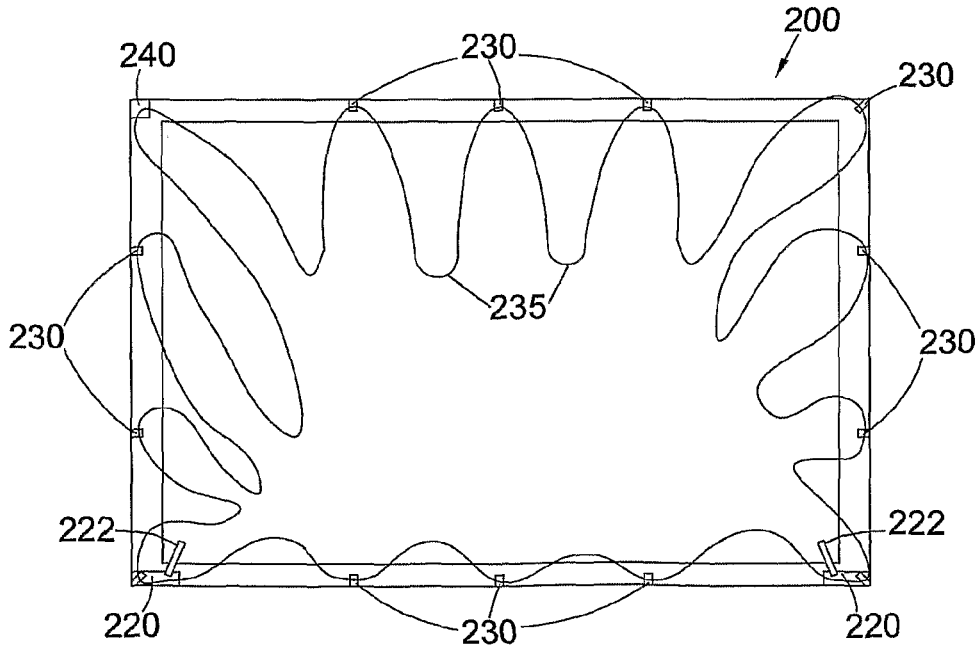
FIG. 1B shows the embodiment of FIG. 1A with the wire loosened for fitting clamps and a poster thereto.
Figure 1C:
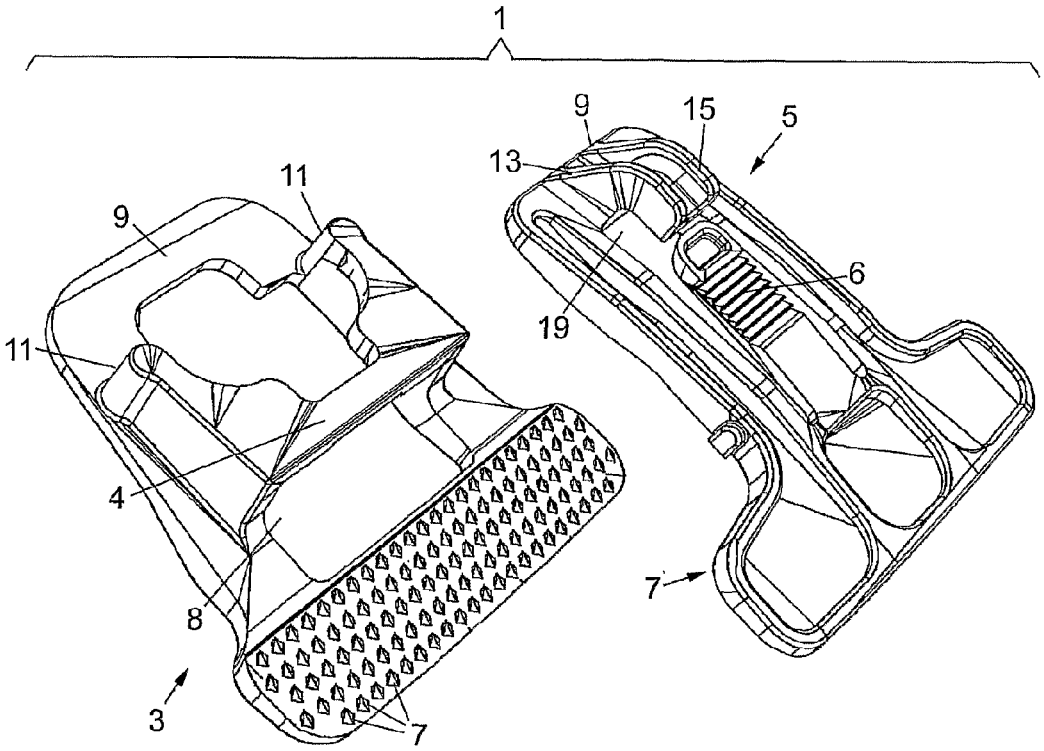
FIG. 1C illustrates a first clamp in accordance with the present invention, in a disassembled configuration.
Figure 1D:
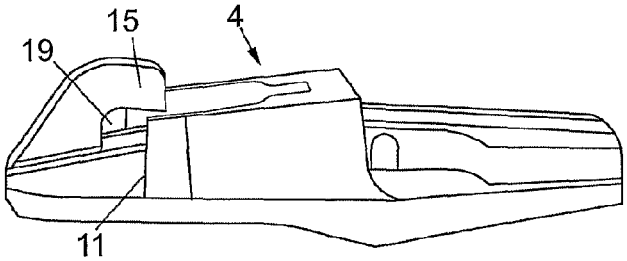
FIG. 1D illustrates the clamp of FIG. 1C in a clamped configuration.
Figure 2:
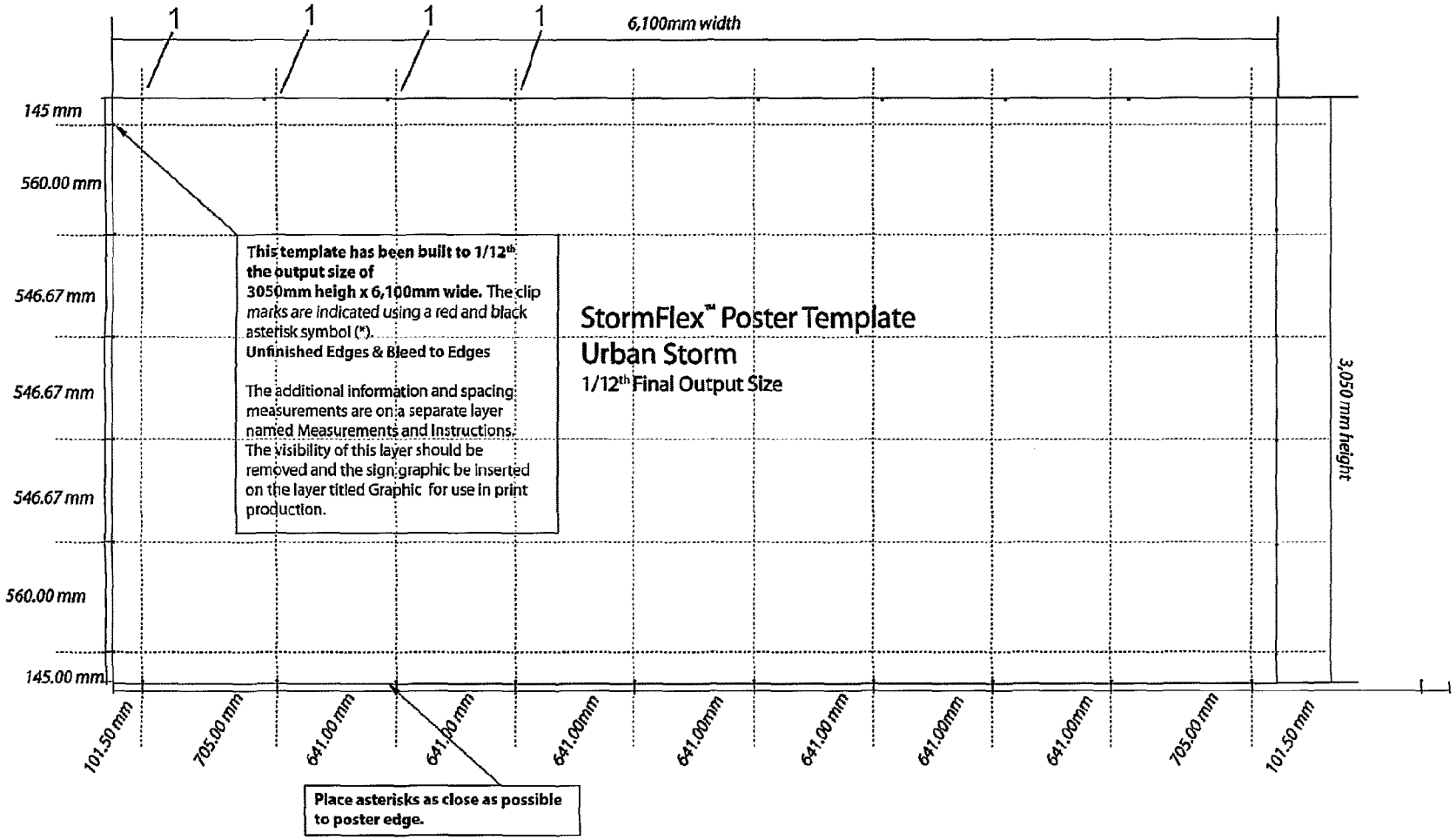
FIG. 2 shows a proposed template for the generation of posters for fitting into the system of FIG. 1.
Figure 7:
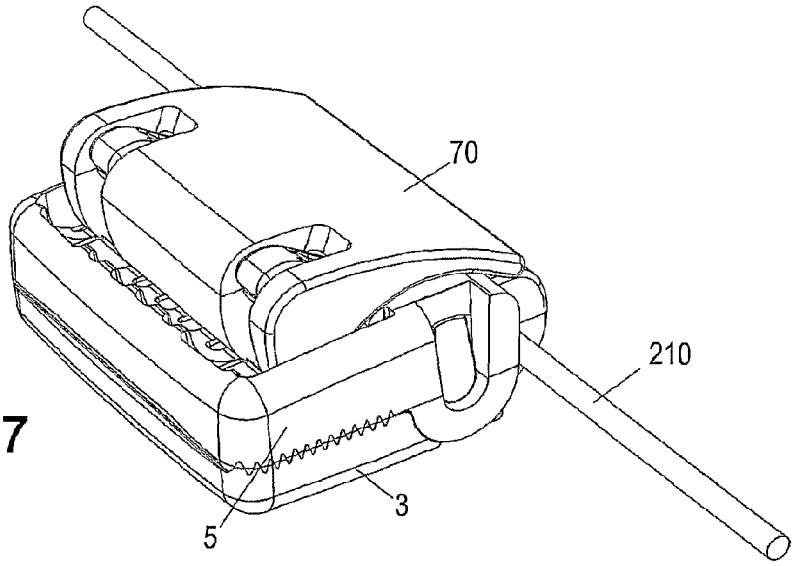
FIGS. 7 to 13 show a first embodiment of a poster clamp in accordance with the present invention in various configurations.

To hold a poster on the hoarding, the wire 210 can receive a plurality of poster clamps 1 (not shown in FIGS. 1A and 1B—see instead FIGS. 1C and 1D or FIG. 7 onwards).

In this embodiment, the wire is fixed 240 in one corner of the mount. The fixing, however, is optional, as illustrated by other embodiments.

The wire 210 passes through loops 230, or on clips or bearings, or the like, around the edge of the hoarding, or the mount. The wire 210 can slide through or over these loops or bearings. Loops may take the form of simple eye screws, or may be customised guides with grooves provided therein—see, for example, FIG. 4. The guides might even have pulleys in them for assisting in guiding the wire when it is tightened from a slack condition, as in FIG. 1B, to a tight condition, as in FIG. 1A.

They loops or bearings or guides may be made from or with a low friction material, or may just have a low friction coating, such as PDFE, for assisting with that wire guidance to prevent excessive resistance to tightening.

Figure 5:
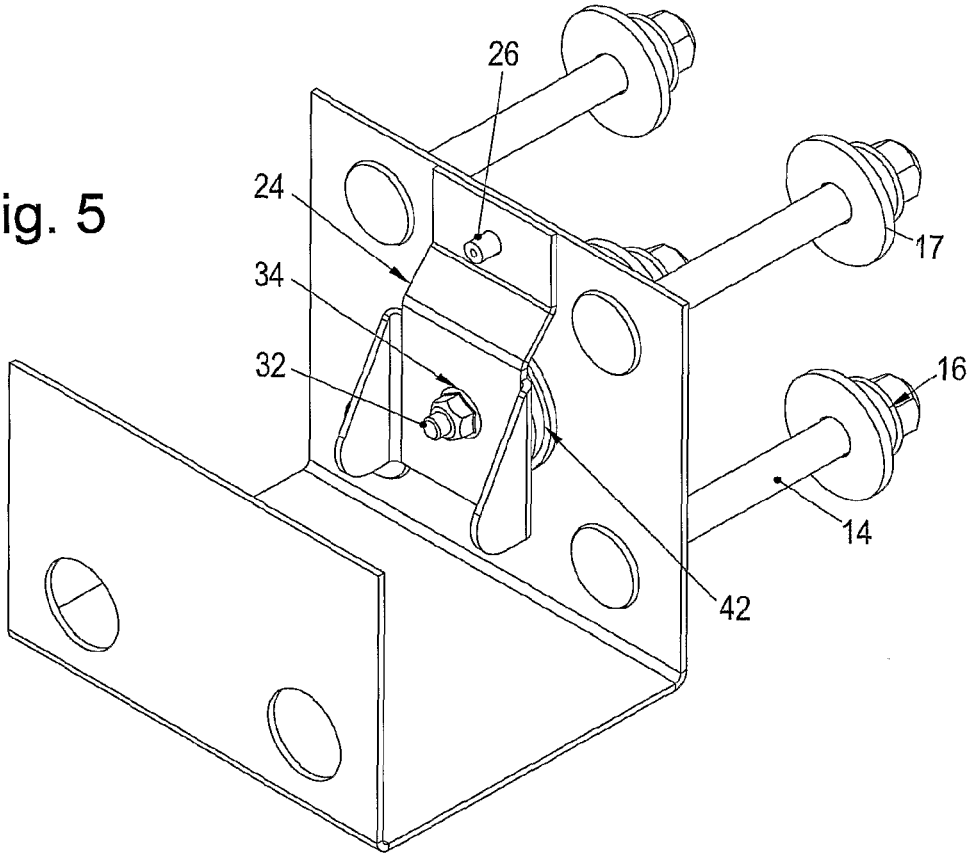
FIG. 5 shows an embodiment of an alternative edge bearer, this time with a pulley wheel, for use with the present invention.

A pulley guide is illustrated in FIG. 5.

As mentioned above, the wire is fixed to the mount. This occurs at a fixing point 240, which is preferably at a corner of the mount or hoarding 208, although it might be elsewhere around the mount or hoarding 208.

The wire 210 in this embodiment has two free ends 210*a*, 210*b*. Once threaded as necessary around the hoarding—any threading needs to be done at this early stage, and once the poster is attached to the wire with the clamps, the wire ends 210*a*, 210*b* may be pulled in opposite directions to allow each length of wire, extending from the fixing point 240, to be tensioned independently of the other for tightening the poster onto the hoarding 208.

The clamps 1 of FIGS. 1C and 1D are releasably attachable to the wire and to a poster (not shown), as described in greater detail in GB0818052.3. The clamps of FIG. 7 onwards are likewise releasably attachable to the wire and be will be described in greater detail below.

The clamps are retained on the wire 210 upon tensioning the wire—the wire cannot then easily be bent out of the clamp's wire-engaging mechanism—the multiple hooking mechanisms resist such a removal by facing in opposing directions.

The two free ends of the wire 210 in this embodiment overlap each other along the lower edge of the hoarding 208. This allows the additional length of the wire, needed to form the loops 235 for attaching the poster/clamps to the wire, to be accommodated.

In use, clamps are attached to the wire at selected locations around the wire to allow them, in the final positions, to engage the poster at spaced positions around the full perimeter of the poster.

The clamps that engage the top edge of the poster are hooked onto the upper part of the wire loop (or the clamps already hooked onto the upper part wire loop are pulled clown to enable the poster to be clamped thereon) by pulling down on the wire to form free-hanging loops 235. The clamping or hooking step may then be done. A next loop 235 can then be pulled down, and the next clamp can be attended to. A pole can be supplied for this purpose. This avoids the need for tall ladders and/or cherry pickers, for the mounting of a poster onto a tall hoarding.

Upon tensioning the wire, after locating all the clamps onto the poster and onto the wire, each free end 210*a*, 210*b* is pulled to tighten it along the whole length of the lower edge of the hoarding. The wire 210 in the ring is then finally tensioned by the use of the two ratchet systems 220, which pull the two fixed lengths of wire taut around the perimeter of the hoarding.

In this first embodiment, the ratchet systems 220 include handles/levers 222 that can be released or applied in then present embodiment in the two lower corners of the hoarding. This creates the application and release of tension.

In an alternative embodiment, adjustable chains may be provided that can be, shortened or lengthened to achieve the desired level of tension for the wires. The chains can link to the ends of the wired using karabiner type connections.

Figure 6:
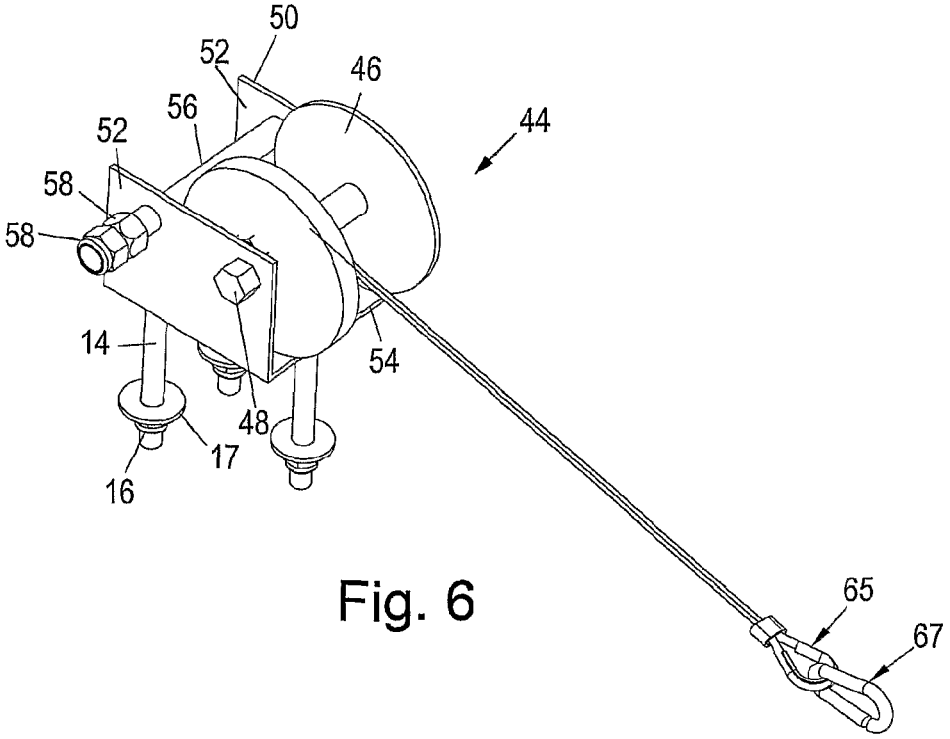
FIG. 6 shows detail of a winch mechanism for use with the present invention.
Figure 38:
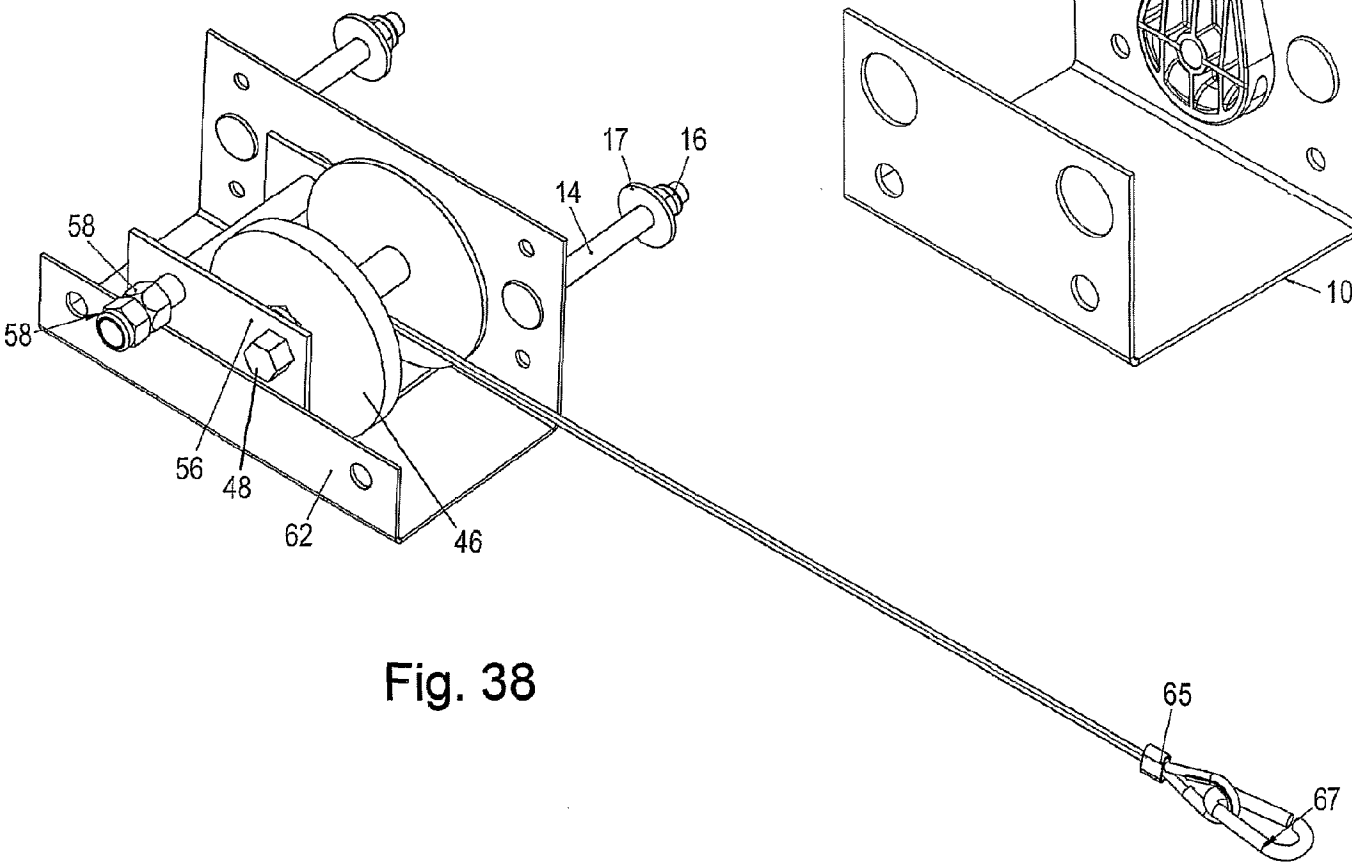
FIG. 38 shows an alternative winch mechanism for use with the present invention.

Another alternative would be the provision of two ratcheted winches. Two possible winches are illustrated in FIGS. 6 and 38.

As indicated above, when the wire is loose, as shown in FIG. 1B, poster clamps which connect the poster to the wire loop can be attached to the wire 210 from the ground (or a base level). Therefore, no climbing equipment such as ladders or the like is needed. A hook, perhaps on a pole, might be needed to pull a loop down. However, the user would not usually need to leave the ground (or the base on which he stands when attaching the poster's bottom edge to the bottom clamps) when access the top loops 235.

As the wire is tightened with the ratchet mechanism 220, the poster is pulled to the edges of the poster mounting for opening out the poster in full.

When the poster is to be removed, the wire 210 is again slackened. This is by releasing the ratchet mechanisms 220 for allowing the tension in the wire to be reduced. This then allows the wire to be moved away from the edge of the hoarding. Once that has occurred, the clamps may then be removed from the wire, and/or the poster removed from the clamps. Often the poster will be removed from the clamps, however, without removal of the clamps from the wire—the clamps can be reused.

The loosening of the uppermost clamps from the poster is done by pulling the wire from the top of the hoarding towards the ground, e.g. with the hook on a pole for avoiding the need for ladders or other climbing equipment. Then the individual clamp or clamps on that loop can be loosened. This is done usually one loop 235 at a time.

Once the old poster has been removed, a different poster can be attached to the mounting system.

Any poster clamp that can engage the edge of a poster, and also the wire, can be used in this system. Preferably, however, the poster clamps for use in this poster mounting system are according to one of the embodiments described herein. They may alternatively be in accordance with any of the embodiments disclosed in the previously mentioned document GB0818052.3.

Figure 4:
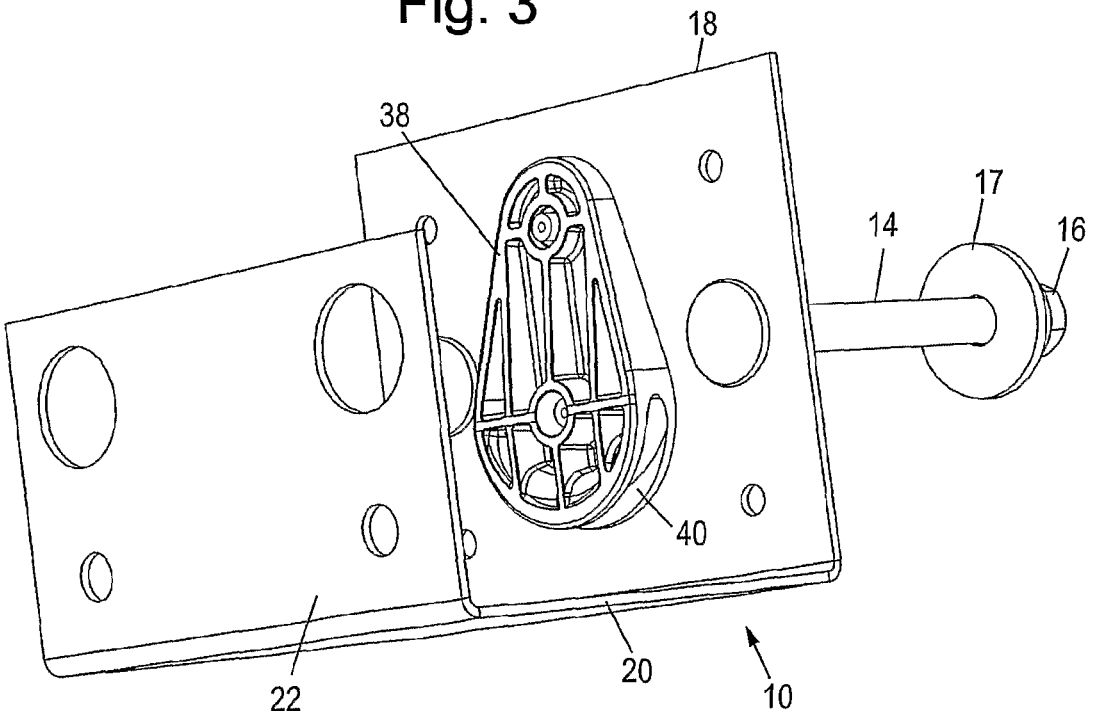
FIG. 4 shows a first embodiment of an edge bearer for use with the present invention.

Referring next to FIG. 1, a possible positional arrangement for the poster clamps 1 and bearings 10, 12 on a poster mounting system of the invention is illustrated. The poster clamps 1 are roughly equally spaced around the perimeter of the billboard. It is possible, however, that additional poster clamps 1 will be provided, for example closer into the corners of the poster. Likewise they may be more closely spaced apart around the edge of the poster. For example, FIG. 4 illustrates a possible poster template with clamp positions illustrated by dots 1 all the way around the template—instead of the four along the long edge in FIG. 1, there are ten clamps 1. Such numbers will better retain a poster having a size of approximately 6×3 meters.

Typical spacings between clamps 1 may be between 500 and 800 mm, depending upon the locations of the clamps on the poster, and typical spacings, as illustrated, are 641 mm, 705 mm, 560 mm and 546.67 mm.

Adjacent the corners, the spacing from the clamp 1 to the corners may be much less. For example, in the illustrated example the distances are 101.5 mm and 145 mm. By making that distance smaller, it is possible to ensure that the poster correctly tightens not just along the sides of the poster, but also into the corners of the poster.

As seen in FIG. 1, the poster clamps 1 are typically located between a pair of bearing members 10 along the sides of the poster mounting system and between the corner bearing members 12, four of which are provided in this embodiment, and an adjacent side bearing member.

Figure 3:
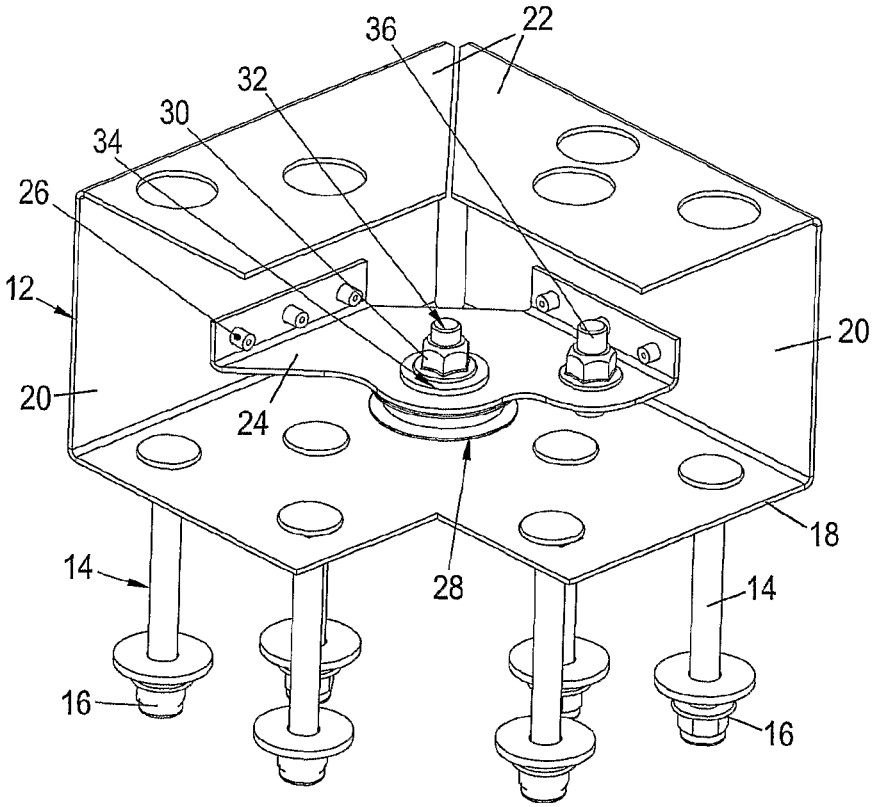
FIG. 3 shows a pulley wheeled corner bearing for use with the present invention.

A first possible corner bearing member is illustrated in FIG. 3. As can be seen, it includes bolts 14, nuts 16 and washers 17 for mounting it onto the hoarding. Those bolts extend away from a base plate 18. The base plate 18 of the corner bearing member 12 therefore gets bolted against the front face of the hoarding.

The corner bearing members 12 additionally have two perpendicularly arranged walls 20 extending perpendicularly away from the base plate 18. Further it comprises two coplanar facias 22 extending perpendicularly from those walls. The facias 22 extend substantially parallel to, and approximately coterminal with the base plate 18. The facias typically combine to provide a smaller surface area than the base plate 18, however, and do not need to be as large as the base plate 18; the facias 22 are simply for carrying a cover (not shown) for hiding the corner bearing members, and side bearing members 10, and also the clamps 1 and wire 210. The cover therefore sits over the top of the mechanisms of the poster mounting system.

Internally of the area defined by the walls 20 the base plate 18 and the facias 22 is a pulley arrangement. The pulley arrangement comprises a mounting plate 24 having perpendicular flanges at its ends that are riveted 26 to the walls 20. The mounting plate additionally has a hole therein (not shown) that can oppose a corresponding hole in the base plate 18. A pulley 28 is mount between the mounting plate and the base plate. The pulley might only be attached to one of those members, however—usually just mounting plate 24.

The pulley 28 is typically mounted to the mounting plate with a nut 30, a bolt 32 and a washer 34.

The mounting plate 24 also carries thereon a second bolt, axially spaced away from the axis of the pulley 28. The second bolt 36 is also positioned such that it won't foul a wire 210 extending perpendicularly around the pulley 28.

The second bolt 36 is for connecting a free end of the wire 210 thereto. It therefore allows the corner bearing member to provide a fixing point 240 for that wire 210. This will be explained in further detail below. The second bolt will not be used at all corners—it is typically only used at one of the lower corners, as will also become clear later.

Referring next to FIG. 4, a side bearing member 10 is illustrated. It likewise has bolts 14 (one shown), nuts 16 (one shown) and washers 17 for affixing it to the hoarding. Further, it also has a base plate 18, a wall 20 and a facia 22. They are again perpendicular to one another and enable the same cover to be attached over the mechanisms via the facia—the cover will extend around the entire perimeter of the hoarding for covering the entire working mechanism of the poster mounting system.

In this embodiment, instead of there being two perpendicular walls 20, only a single wall is provided—the wire will pass through the bearing in a straight line, rather than in a right angle.

In this embodiment, the base plate 18, the wall 20 and the facia 22 define a U-shaped member.

A bearing 38 is attached to the base plate 18, e.g. by further bolts or rivets. The bearing 38 has a slotted groove 40 along one edge thereof for carrying or guiding the wire 210 therein.

Referring next to FIG. 5, an alternative side bearing member is illustrated. It has similarities to the previous side bearing member. However, instead of the fixed bearing 38, it has a rotatable pulley wheel 42. The pulley wheel bearing 42 is bolted onto a mounting plate 24 with a bolt 32, nut and washer 34. The mounting plate 34 is riveted 26 to the base plate 18.

Referring next to FIG. 6, a possible winch arrangement 44 is illustrated for tensioning the wire 210 around the hoarding. The winch 44 is only shown schematically since ratcheting winches are known to skilled persons. The winch, however, has a ratcheting system and means for turning the drum 46 of the winch 44. Such a means for turning the drum 46 can simply be a spanner that is attached to a central nut 48 of the drum.

The winch 44 is mounted within a frame 50, the frame 50 having two sides 52 and a base plate 54. The base plate 54 has bolts 14, nuts 16 and washers 17, as with the bearing members 10, 12, for attachment to the front of hoarding.

A further bolt is also positioned to span between the sides 52 of the frame of the winch 44. This bolt can help to prevent the sides 52 from flexing relative to each other so as to make the winch stronger.

The winch arrangement 44 has a short length of cable extending therefrom, which cable is attached to the drum 46. The free end of that cable has a loop 65 formed therein and a karabiner type connector 67 for linking it to a loop in the end of the wire 210.

Figure 36:
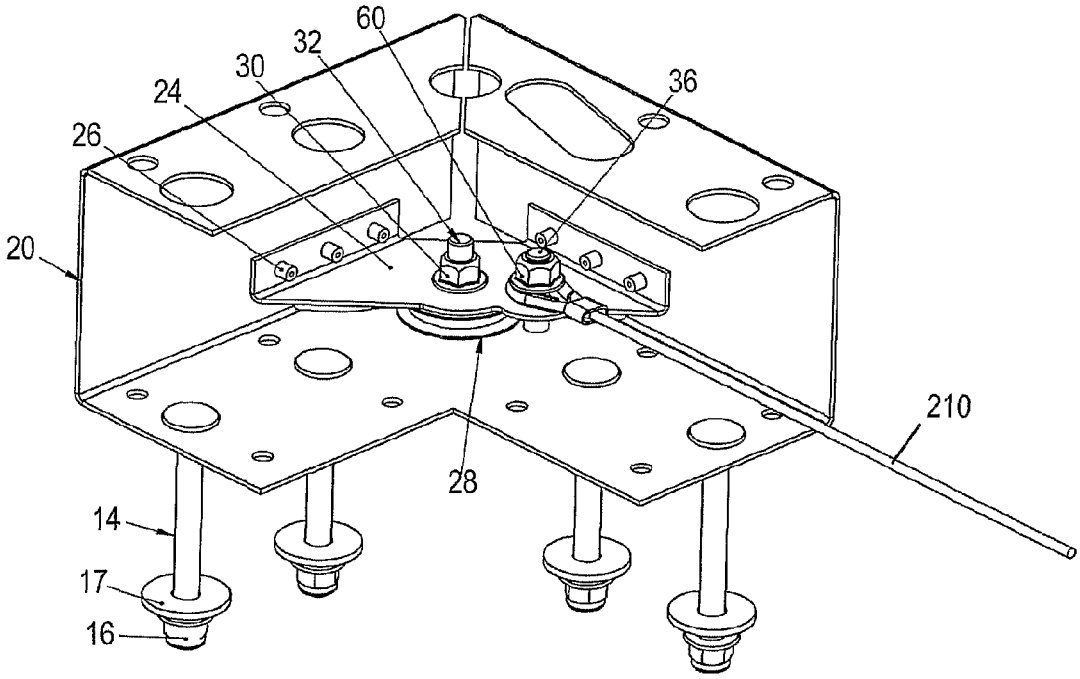
FIG. 36 shows an alternative pulley wheeled corner bearing for use with the present invention.
Figure 37:
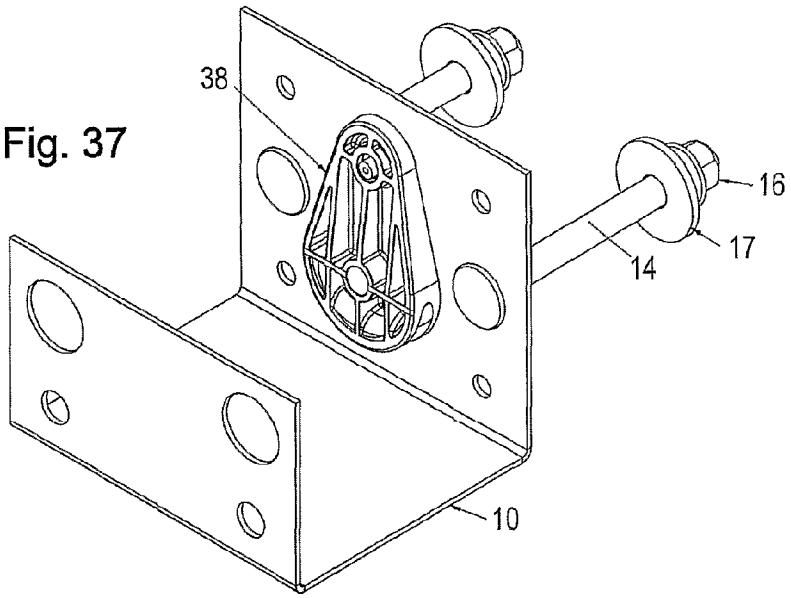
FIG. 37 shows an alternative edge bearer for use with the present invention.
Figure 39:
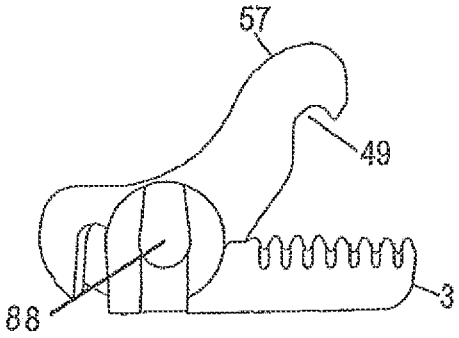

Referring next to FIGS. 36, 37 and 39, slightly different accessories are illustrated.

The corner bearing member 12 of FIG. 36 has a slightly different design to that of FIG. 3. Functionally, all the same features are again provided, albeit with a slightly different configuration. However, this Figure additionally shows an end of the wire 210 bolted onto the mounting plate 24 by means of the second bolt 36, via a nut 60 and washer. For that purpose the end of the wire 210 has a loop formed therein for fitting over the second bolt 36.

Referring then to FIG. 37, another side bearing member 10 is illustrated. It is very similar to the previously described side bearing member 10, but with different sized frame members. A farther description is therefore not required.

Referring next to FIG. 38, an alternative arrangement for the winch arrangement 44 is shown. In this arrangement, the drum 46 of the winch arrangement 44 is adapted to be mounted with its axis extending perpendicular to the mounting surface of the hoarding. In the previous embodiment of FIG. 6, that axis was parallel to the hoarding. Mounting the drum in this different orientation, however, allows easier access to the nut 48 for winching the drum 46.

Referring next to FIGS. 30 to 33, one arrangement for mounting these side bearing members, and corner bearing members, and the winch, all onto a hoarding is illustrated. The hoarding, however, is not illustrated since they may alternatively be mounted onto a separate frame for holding them in their predetermined configuration, which frame is then mounted onto the hoarding.

Figure 30:
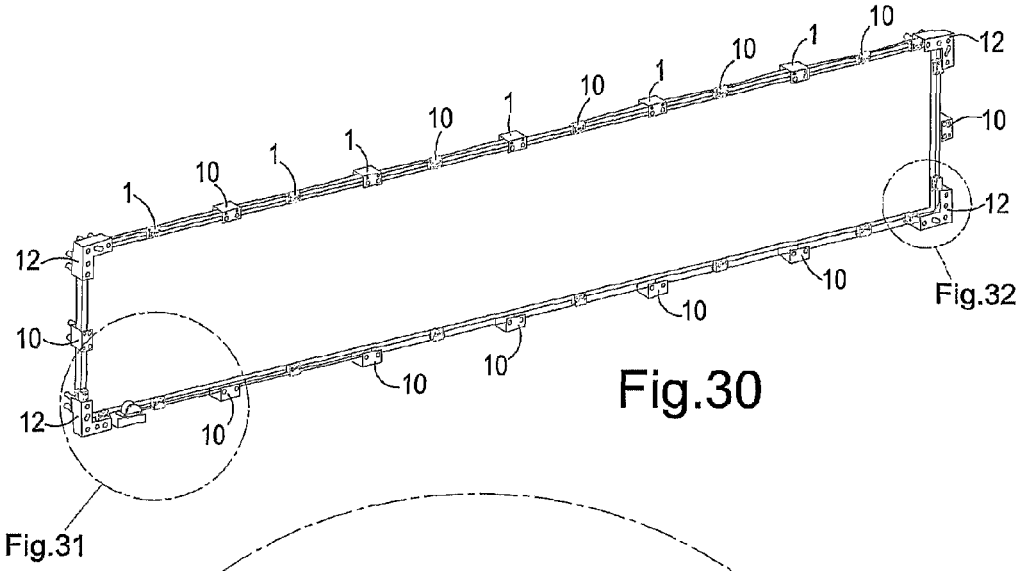
FIGS. 30 and 33 show a preferred arrangement for a hoarding for an approximately 6 by 1 meter poster.
Figure 31:
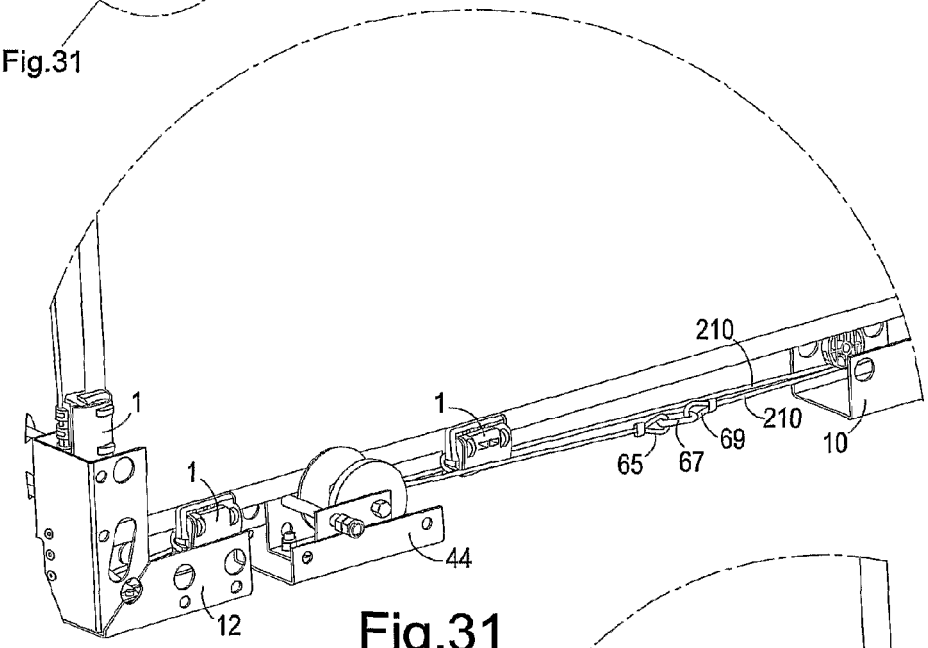
FIGS. 31 and 32 show corresponding details from FIGS. 30 and 34.
Figure 32:
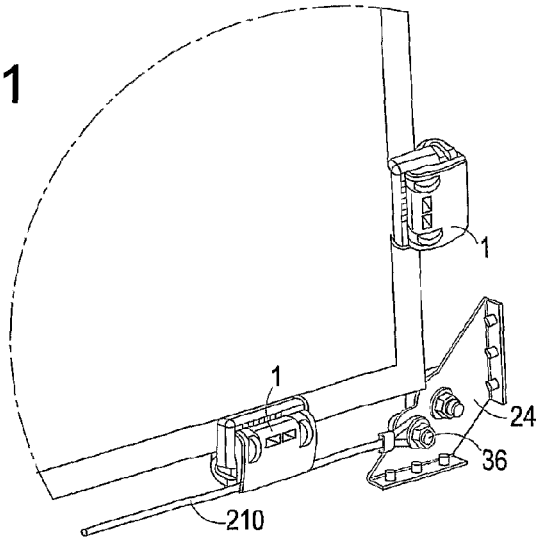
Figure 33:
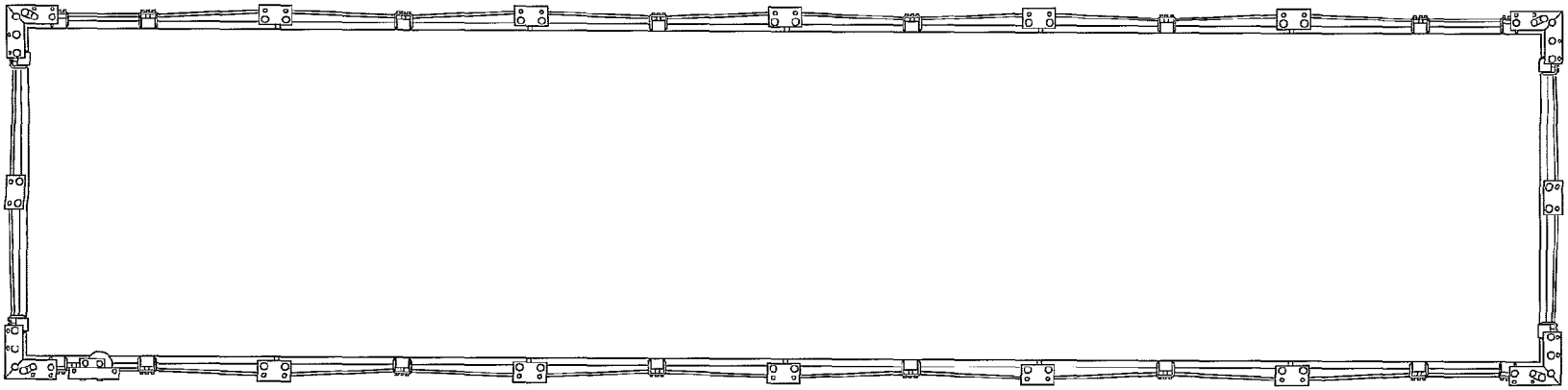

The arrangement shown in FIGS. 30, 31 and 32 clearly illustrates four corner bearing members 12 and a plurality of side bearing members 10. In this embodiment there are five side bearing members 10 along each long edge and one on each short edge. This should be adequate for a poster of approximately of 6×1 meters.

Figure 34:
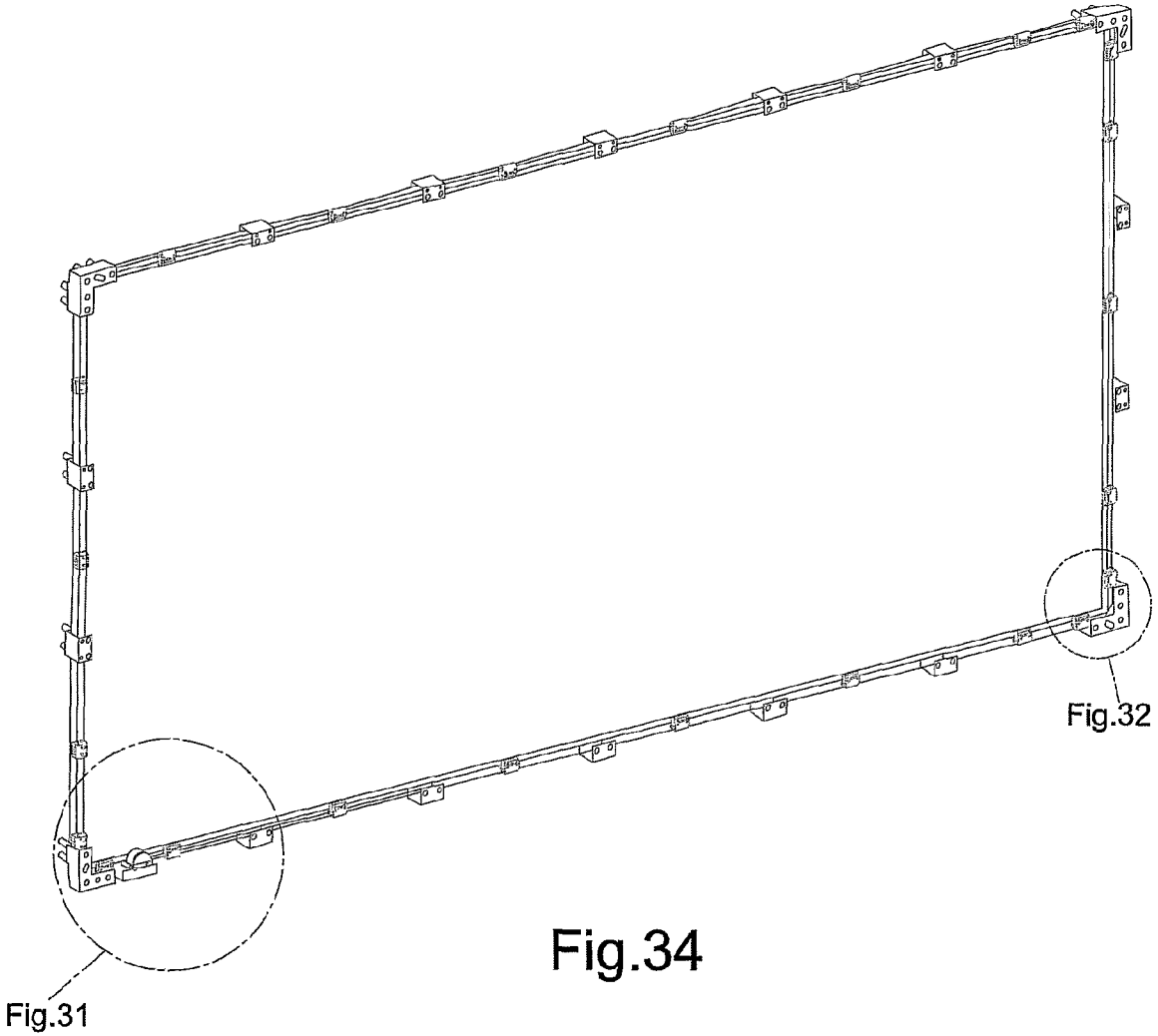
FIGS. 34 and 35 show a preferred arrangement for a hoarding for an approximately 6 by 3 meter poster.
Figure 35:
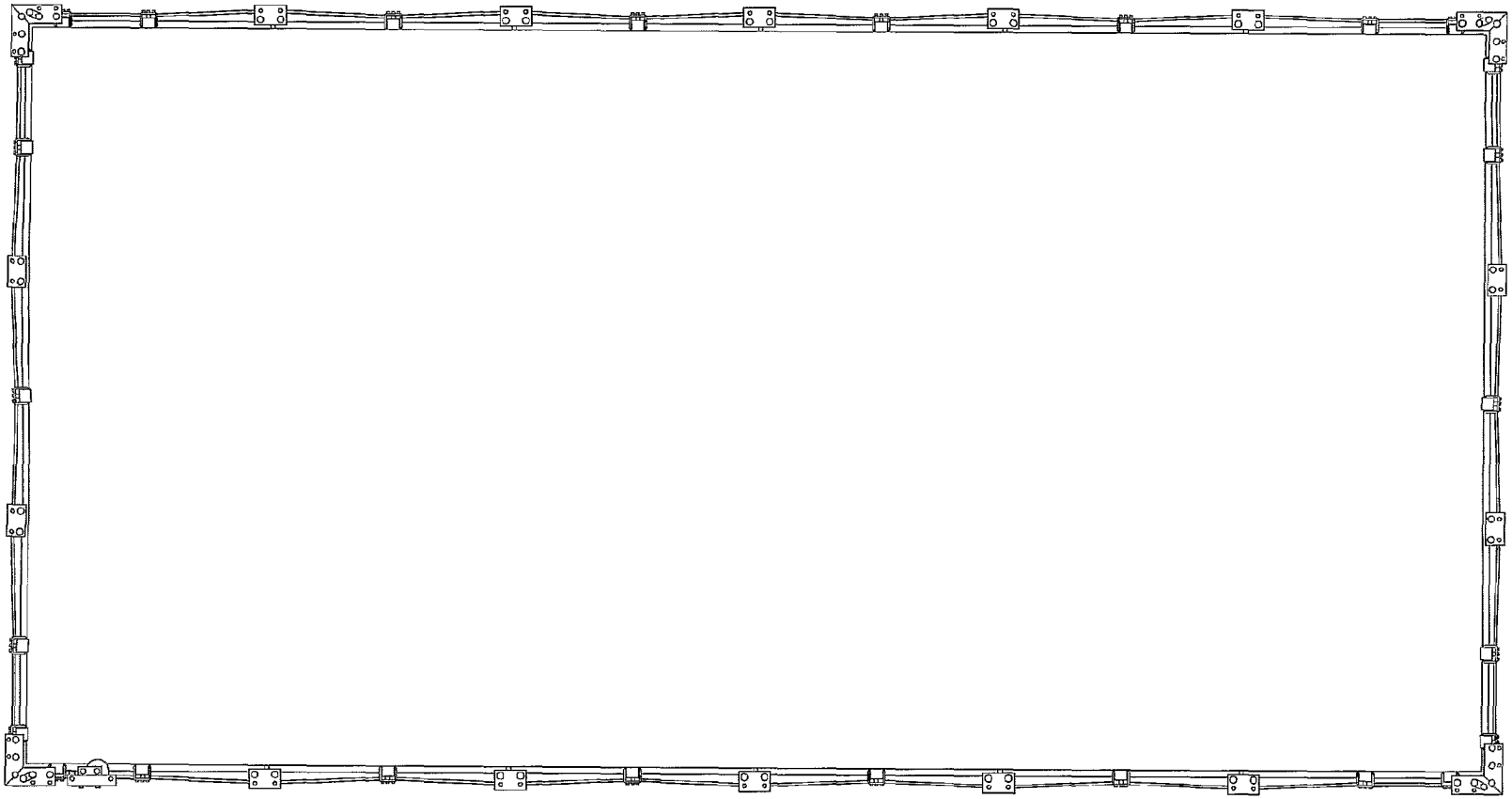

Referring then, briefly, to FIGS. 34 and 35, an alternative arrangement is shown—for a hoarding for a poster size of approximately 6×3 meters. In that alternative arrangement, instead of just one side bearing member on each side, two side bearing members are provided on each side of the hoarding.

Clamps 1 are also shown in these drawings. They are engaging an edge of a poster, as shown in FIG. 32. One clamp 1 is illustrated between each pair of side bearing members, or between each corner bearing member and its adjacent side bearing member 10. However, additional clamps 1 may be used in practice. They will be located, however, such that they won't foul against the bearing members.

As shown in FIG. 32, the wire 210 is fixed at one end to a second bolt 36 of a mounting plate 24. The preferred corner is the bottom right hand corner (with the winch towards the bottom left hand corner (in FIG. 32, the base plate, the walls and the facias of that corner bearing member 12 have been removed for clarity).

That location for fixedly attaching a first end of the wire is chosen so that the wire 210 can then extends all the way around the poster for engaging a continuous array of clamps. The wire 210 therefore first extends along the bottom of the hoarding. It then extends through the first corner bearing members it encounters (at the bottom left). It then extends up the left hand side of the hoarding, through the next corner bearing member 12, over and along the top edge, through the topright cornet bearing member 12, back down the right hand side, through the first corner bearing member, and then across back towards the winch arrangement 44. The side bearing members 10 can engage the wire at this time if desired, but it is not obligatory with the side bearing members of FIGS. 4 and 37 since the wire 210 can just be hooked onto them as desired. The embodiment of FIG. 5, however, may require a threading of the wire onto the pulley wheel (as with the corner bearing members 12).

The free end of that wire, i.e. the length and end that passes along the bottom of the system for the second time, has a loop 69 thereon. That loop 69 is for attaching to the karabiner 67 of the winch arrangement 44 when any final tightening of the wire/poster is needed.

By having the free end of the wire extend across that fall length of the bottom of the hoarding, there will be plenty of free length in the wire 210 to allow the loops 235 (described with reference to FIG. 1B) to be gathered by the pole (not shown) during the mounting or dismounting of a poster onto the system. It will even allow the loops 235 to be significantly larger, i.e. spanning between the two upper corner bearing members—this is possible since the side bearing members of FIGS. 4 and 37 allow the wire just to be hung onto the grooves 40 in the bearings 38—they don't require the wire to be threaded onto a pulley, Referring next to FIGS. 1C and 1D, a brief description of this first embodiment of clamp will be provided. However, a more detailed description is provided in the applicant's earlier application, GB 0818052.3.

That clamp 1 comprises a first member 3, a second member 5 and both gripping and abutting surfaces 7, 9 on each of the first and second members 3, 5. In this embodiment, the gripping surfaces 7 each include a plurality of projections arranged in an array. Further, the corresponding projections on the opposing gripping surfaces can be may be laterally displaced relative to each other so that the two gripping surfaces can intermesh with one another.

The first and second members 3, 5 are arranged to be joined together—see FIG. 1D. For that purpose, an end of the second member 5 can thread through a hole 8 in the first member 3 and then the second member 5 can be rotated such that the two abutting surfaces 9 of the two members 3, 5 face each other. At that point, a tongue 6 on the second member 5 will start to engage underneath a bridge 4 that is provided on the first member 3, that extends across the hole 8 of the first member 3.

The tongue 6 has a plurality of teeth 2 for allowing a ratcheting of the second member 5 relative to the first member 3 on the underside of the bridge 4.

The first member 3 also has two risers 11 forming the walls of the bridge 4. Those risers 11 are positioned to work together with a projection 13 on the second member 5 so as in use to capture the wire 210. For that purpose, the projection 13 has a barb 15 for defining an opening or space 19 through which the wire 210 can pass before extending past the two leading edges of the risers 11.

The wire, together with the tongue 6 and bridge 4, therefore secure the clamp 1 onto the wire 210, and the clamp can then clamp a poster (not shown) between the gripping surfaces 7 of the two members 3, 5.

The assembled state is shown in FIG. 1D.

Referring next to the embodiment of FIGS. 7 to 13, the clamp again comprises a first member 3 and a second member 5. However, rather than a sliding fit between the first and second members 3, 5, this embodiment has a pivotal connection between the first and second members 3, 5. It also comprises a third member 70.

Figure 8:
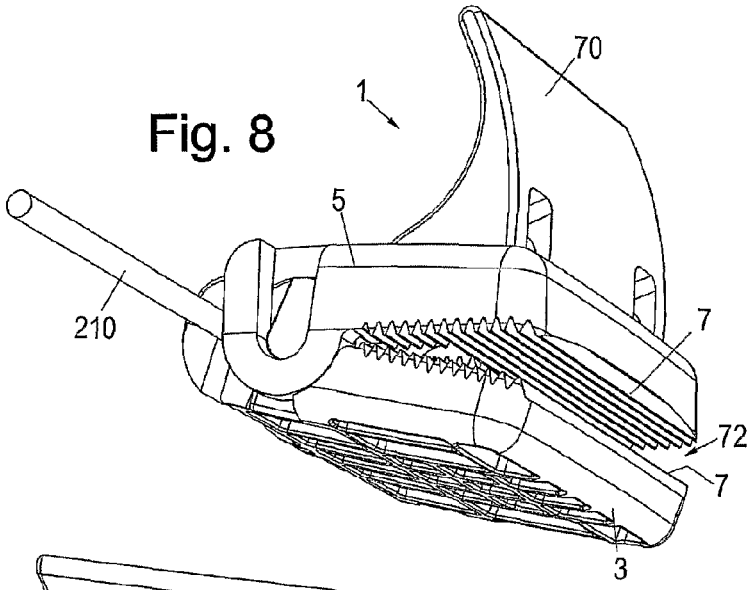

As illustrated in FIG. 8, the first and second members, 3, 5, both have gripping surfaces 7. Each gripping surface 7 is formed from a plurality of parallel grooves. The grooves extend between the sides of the first and second members, i.e. parallel to the wire 210 once the clamp 1 is mounted thereto.

The grooves are formed by serrations that have an approximately equilateral section. Preferably, the point angle of the triangle is between 75 and 40°, although angles of about 70°, 60° and 50° have been found to be suitable for providing an adequate grip. The most preferred angle is approximately 50°. Other shapes can also be used, for example saw-tooth arrangements with non equal sides, or rounded shapes.

The grooves of the first member 3 are displaced relative to the grooves of the other member 5 so as to allow the serrations to intermesh upon clamping the clamp into a closed position. This allows a poster to adopt a shape corresponding to the grooves so as to increase the clamping strength of the poster within the jaw 72 of the clamp 1.

Grooves other than parallel grooves might be provided instead of the parallel grooves. Further, in place of the grooves, other shaped gripping means can be provided.

Figure 9:
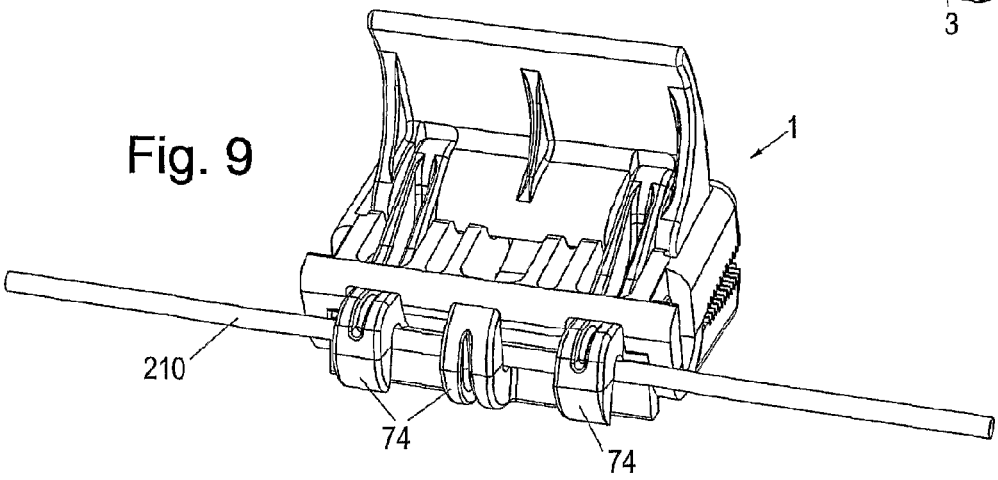
Figure 10:
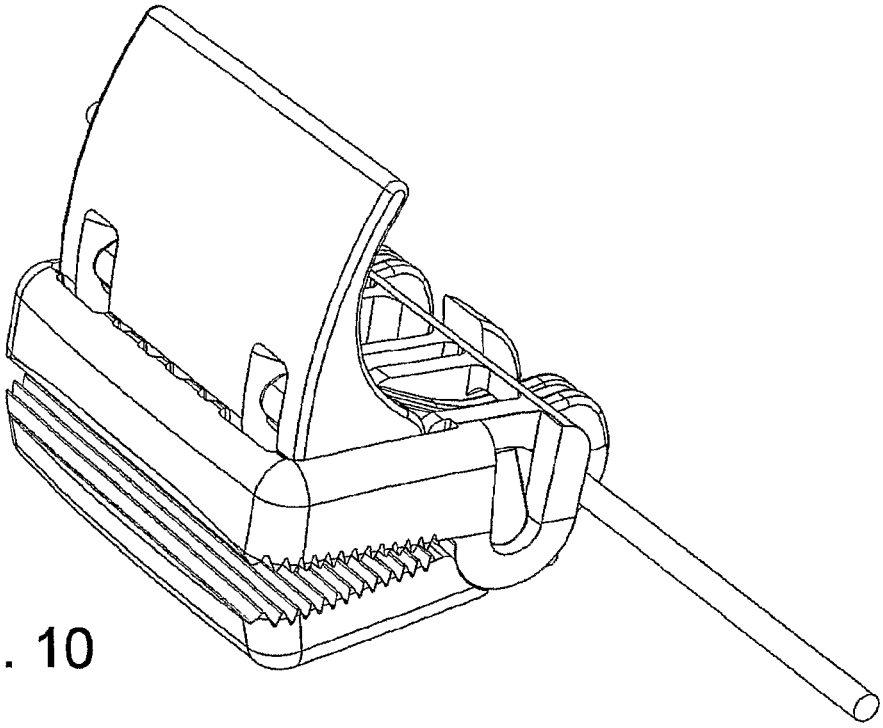

Referring next to FIG. 9, three hook members 74 are illustrated. Those hook members 74 are for hooking the clamp 1 onto the wire 210.

Two of the hook members points its opening in one direction and the third (middle) hook member points its opening in the opposing direction. This is to prevent the inadvertent release of the clamp 1 from the wire 210, such as while the wire 210 is extending in a straight line between the hook members 74 (i.e. in a condition where the wire 210 has been tightened). In order to disengage the wire 210 from the hook members 74, the wire 210 will therefore need to be slackened. Then it can be bent around the hooks 74. The clamp 1, therefore, is securely retained on the wire 210, albeit in a manner that allows it to be easily removed therefrom, if desired by a user.

As is readily apparent from the drawings, the three hook members 74 are spaced apart relative to one another along the length of the wire 210. That spacing allows the wire to be removed from the hook member 74 upon bending it around the hook members 74.

All three hook members in this embodiment are attached to a rear edge of just one of the first and second members 3, 5. In this example that member is the first member 3. This means that the hook members 74 are in a permanently fixed position relative to one another.

Figure 11:
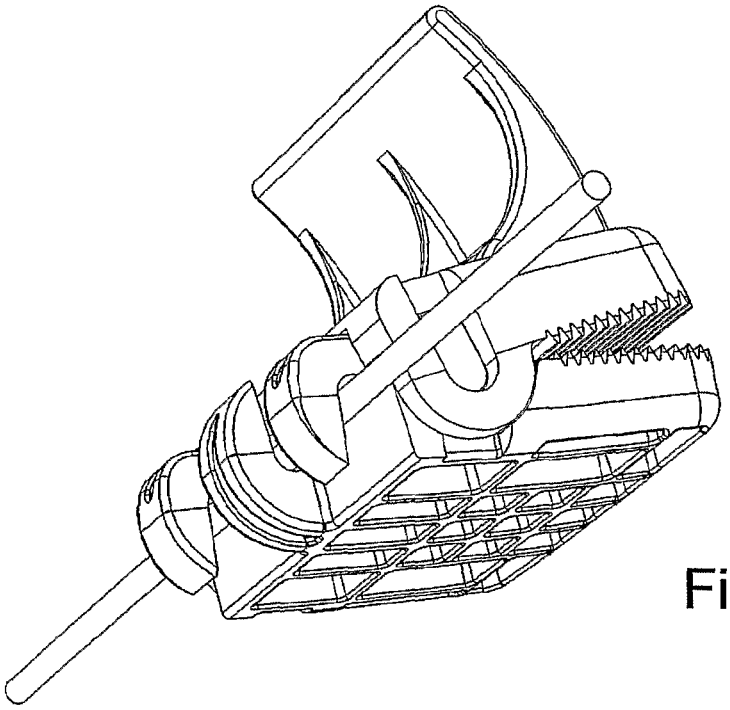
Figure 12:
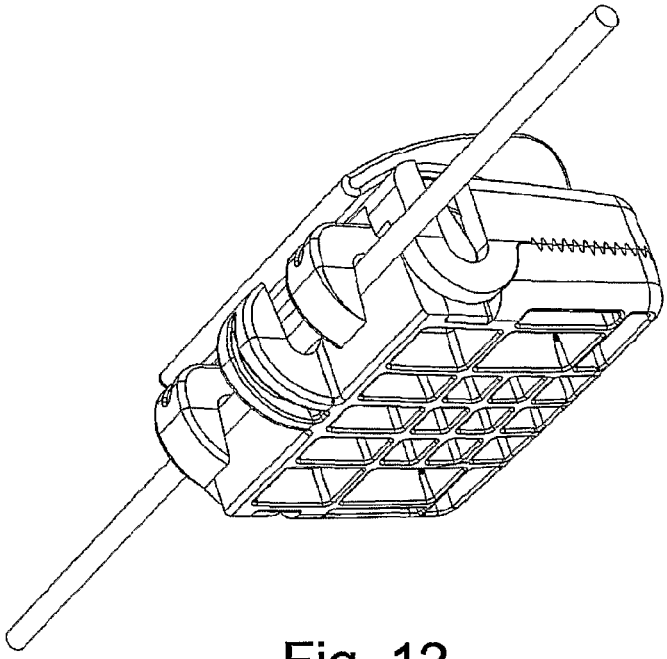
Figure 13:
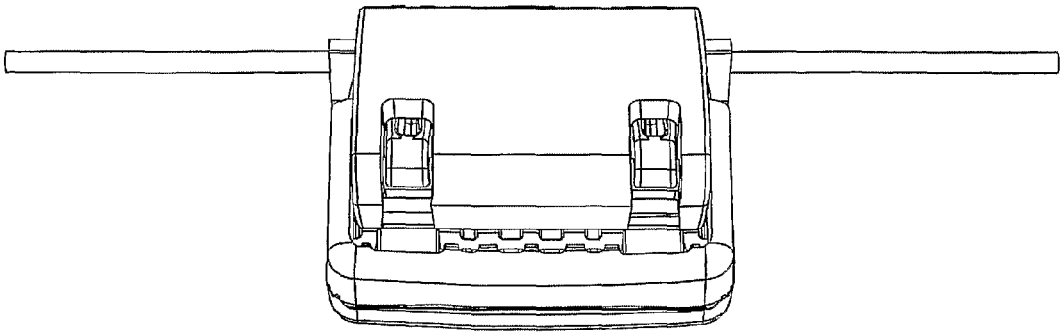

The hook members 74 are also clearly shown in FIG. 11.

The basic principle of operation of this device is identical to that of the embodiment of FIGS. 14 to 29 and 49 to 41. Accordingly, we will now refer to that later embodiment for a further explanation of the clamp's features. It should first be observed, however, that there are some minor differences in the detail. Those differences include the following:

First of all, a finger grip or convex lip 76 is provided at the free end of the third member 70. In the other embodiment the lip is substantially straight. This convex lip 76, however, that can have a variety of shapes (curved or otherwise) allows a user more easily to grasp the third member for releasing the clamp 1—release of the clamp involves lifting the free end of the third member 70 away from the second member 5. The convex shape also allows a tool to be inserted between the lip 76 and the second member 5, or between the lip 76 and one of the hook members 74 (preferably the middle one) for prising open the third member 70 relative to the second member 5. This can be achieved because the convex shape provides a void or space 78 for accommodating the tool.

A second difference is the provision of writing either printed or moulded onto the top surface of the third member 70. This writing allows instructions, or product details, to be displayed to a user. This is of particular use in circumstances where a range of different third members are available, each for clamping the clamp 1 down to a different thickness, e.g.

for allowing thick and thin posters both to be accommodated. This is because the printed or moulded on details can indicate which thickness of poster the particular third member is designed for. For example, "2" or "2 mm" might be printed onto a third member for clamping the jaw 72 upon a 2 mm thick poster. This variability feature, and how it is achieved, will be disclosed in greater detail below when referring to the camming portion 53.

The third significant difference is the provision of a pair of holes 82 in a hub 80 of the third member. See FIGS. 16 and 25 for a clear illustration of those holes 82. Those holes 82 are for receiving a pair of prongs 84 provided on a first end of a clamp removal tool 86. The tool 86 is shown engaged with the two holes 82 in each of FIGS. 14, 15, 20 and 21.

The clamp removal tool is simply a moulded product having a length and rigidity that is sufficient to allow it to be used to prise open the clamp, either via the space 78 under the lip 76 or via the pair of holes 82 in the hub 80 of the third member 70. That tool's stiffness can be provided by means of ribs in the product's moulding, or by means of making the product of a solid cross-section. The ribbed arrangement, however, is preferred due to the resulting cost savings on materials.

If desired, the two prongs 84 can be replaced by a single prong, or the clamp removal tool can be replaced with a screwdriver. Likewise, the two holes 82 can be replaced with a single hole, or it can be omitted, as with the earlier embodiment. The provision of the two holes, however, allow a unique tool to be provided for assisting with opening the clamp 1 since a standard screwdriver is less likely to fit into the two holes. The clamp removal tool therefore becomes an important accessory for supplying with the clamp 1.

Preferably the two prongs are sized and shaped to tightly fit into the holes 82. The holes may be tapered so that it narrows the deeper you get in, whereby the clamp removal tool can positively tighten within the holes as it is inserted into them.

Figure 17:
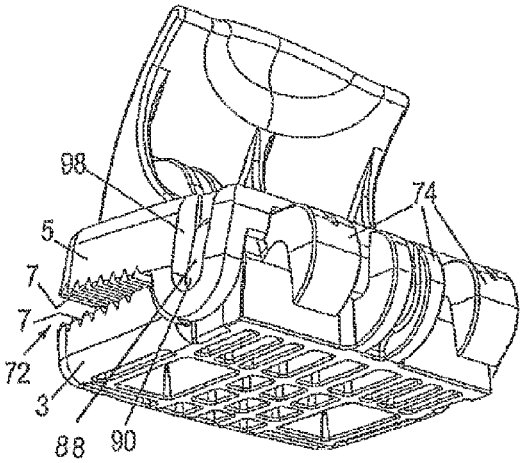

Referring next to FIG. 17, it can be seen that the structure of the first member is defined by a plurality of ribs to provide it with a strong resistance to bending. This is preferred to a solid structure again to reduce material quantities.

Still referring to FIG. 17, it can also be seen that the two gripping surfaces 7 of the first and second members 3, 5, define a jaw 72 in which an edge of a poster can be gripped. For opening and closing that jaw, the first and second members 3, 5 are pivotally connected together about a jaw pivot 88.

The degree of opening of that jaw is relatively small—typically between 5 and 20°. The degree of opening will be restricted by the shape of the pivot axle 88, as shown in FIGS. 26 and 39, and the shape of the hole 98 in which the axle 88 turns.

Figure 26:
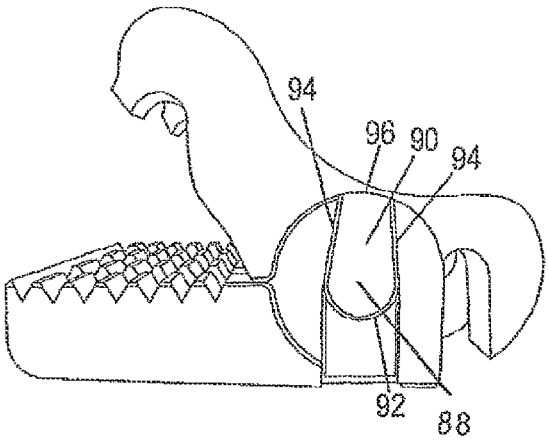
FIGS. 26, 39, 40 and 41 show the first member of the embodiment of FIG. 14 in isolation from the second and third members.
Figure 27:
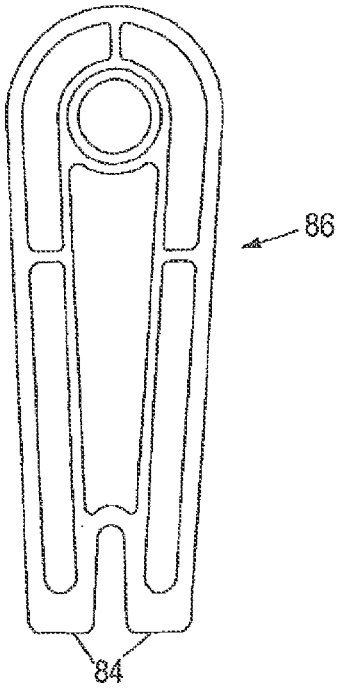
FIG. 27 shows the clamp release tool of FIG. 14 in isolation from the clamp.
Figure 28:
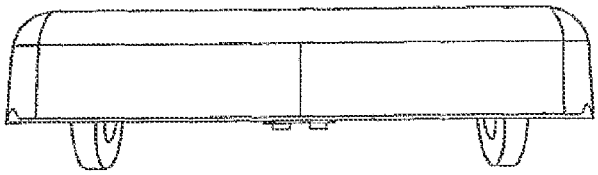
Figure 29:
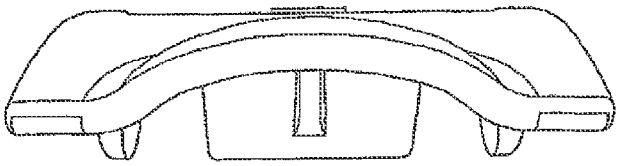

As shown in FIGS. 26 and 39, the pivot 88 has an axle 90 with a rounded bottom wall 92 and two side walls 94. The side walls 94 are diminishingly tapering with respect to one another as they extend away from the bottom wall 92 so as to provide a top wall 96 that is less wide than the rounded bottom wall 92. The angle of that taper approximately equates to the degree of opening available for the jaw 72, subject to the shape of the hole 98, and depending upon the tolerances of the pivotal axle 90 with respect to the hole 98 in the second member 3 into which the pivot axle 90 rotates. Therefore, if the hole 98 is wider than the width of the rounded bottom wall 92, the degree of opening of the jaw 72 can in theory exceed the angle of taper between the two side walls 94 of the pivot axle 90. Likewise, if the walls of the hole 98 taper, that can also change the degree of opening of the jaw 72. The actual degree of opening available for the jaw 72, however, will finally depend upon the design of the third member (as explained below, the camming portion of the third member governs the relative movements of the first and second members 3, 5 and can influence the degree of opening of the jaw 72 because the third member 70 provides a camming member for controlling the open/closed state of the jaw 72).

In the illustrated clamp 1, there is a corresponding pivot axle 90 and hole 98 also on the other side of the clamp 1. The two pivots 88 defined thereby are coaxially arranged, and are positioned towards the rear of the two members 3, 5.

The hook members 74 for engaging the wire 210 extend further rearwardly, i.e. from the back wall of the first member 3.

The hole 98 provided in the second member 5 can itself be tapered so as also to control the degree of opening available for the jaw 72.

Figure 16:
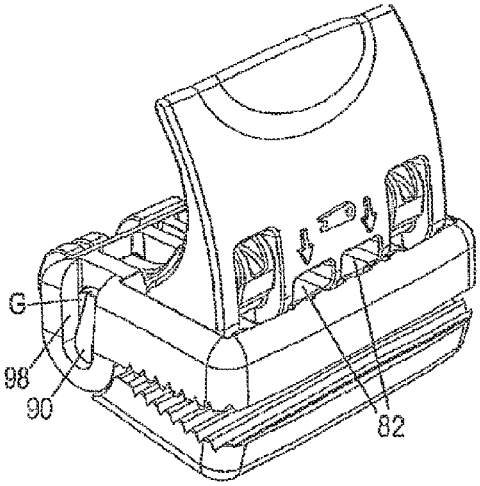
FIGS. 16 to 19 show the embodiment of FIG. 14, but without the release tool provided therein.
Figure 18:
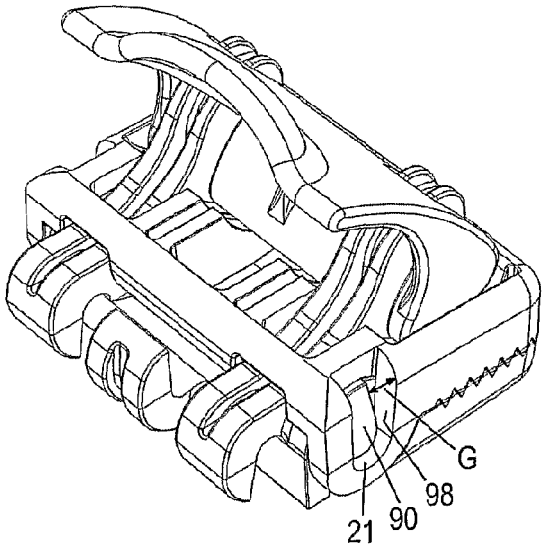

The effect of the taper or tapers is illustrated by comparing FIG. 16 with FIG. 18. In FIG. 16 there is a gap G between the hinge axle 88 and the hole's rear wall. That gap G, however, switches to the other wall (the front wall of the hole 98) when the jaw 72 is closed. See FIG. 18.

Figure 23:
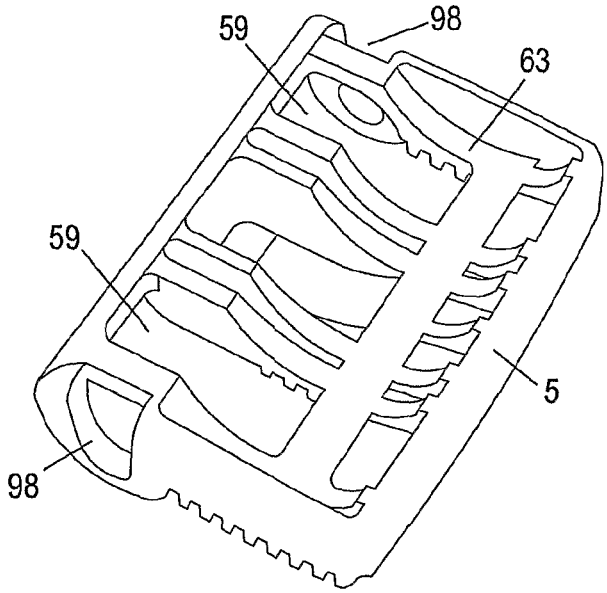

FIG. 23 also clearly shows the tapering sides of the holes 98.

The hole 98 is also elongated. This is to allow the pivot axis 88 to float relative to the member carrying the holes 98, i.e. the second member 5 in this embodiment. Such a floating pivot axis 88 allows different thicknesses of poster to be accommodated in the jaw 72. This is important so that the jaw, where possible, can clamp down onto a poster's edge such that the two gripping surfaces 7 remain parallel to one another. This is so that a sufficient clamping grip is applied to the poster for keeping hold of it even in high wind conditions.

For a thin poster, the pivot axis 88 sits away from the bottom of the hole 98, i.e. the rounded bottom wall 92 of the pivot axle 98 will be spaced away from the curved bottom 21 of the hole 98. However, if the poster is thicker, the pivot axis 88 will displace such that it is closer to the bottom of the hole.

Typically, posters up to 2 mm thick can be accommodated in the clamp while still allowing the two gripping surfaces 7 to be clamped parallel to one another onto the poster.

The holes 98 are also arranged to have an open top, whereby assembly of the first and second members will just involve the stacking of one piece on top of the other, with the pivot axle 90 simply then sliding into the two holes 98 with a snap fit.

The snap fit is provided by means of the pivot axles 90 having, in addition to the relatively tapering side walls, a tapering front face, such that the pivot axle 90 itself has a varying depth relative to the side of the first member 3, with a thin dimension at its top wall 96 and a thicker dimension at its rounded bottom wall 92. With this arrangement, upon assembling the first and second members 3, 5 together, the two members will snap together with the bottom wall of the apertures 98 riding up the tapering end walls of the pivot axles 90 until passing over the rounded bottom wall 92 with a snap. Dismantling the clamp 1 is then difficult. However, indentation 91 may be provided in the side walls of the first member 3 to facilitate the dismantling of the clamp 1—with two small screwdrivers in those indentations, the bottom wall of the apertures 98 can be forced or prised out and over the rounded bottom wall 92 for releasing the relative engagement between the first and second members 3, 5.

Figure 24:
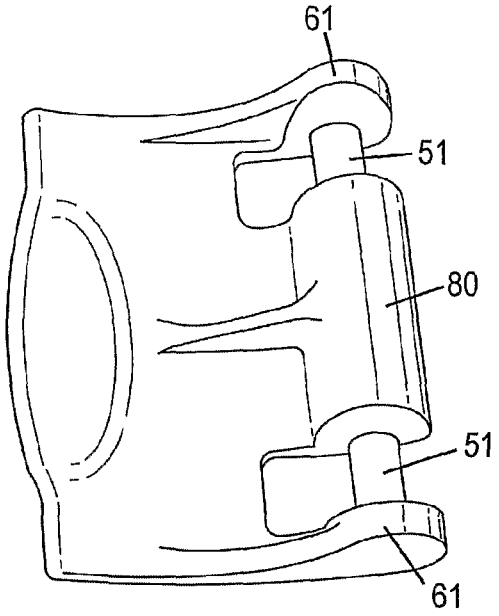
FIGS. 24, 25 and 29 show the third member of the embodiment of FIG. 14 in isolation from the first and second members.
Figure 25:
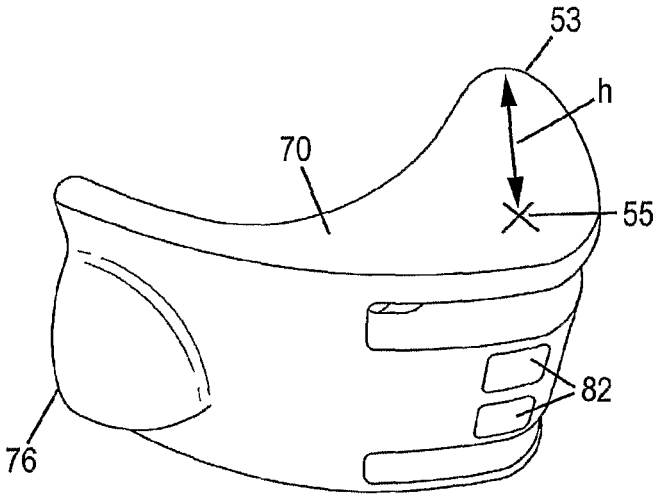

Referring next to FIGS. 24 and 25, the third member 70 will now be described in greater detail.

The third member 70 includes the convex lip 76, as previously mentioned, on a free end thereof. It also comprises two spaced hinge pins 51 towards the opposite edge. Those hinge pins 51 are adapted to engage grooves or hooks 49 provided in posts 57 of the first member 3, as will be described later with reference to FIG. 39.

Figure 14:
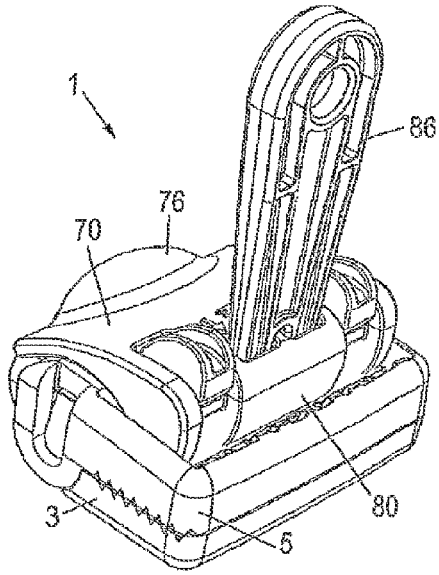
FIGS. 14, 15, 20 and 21 show a further embodiment of a poster clamp, but with a clamp release tool provided therein, the clamp comprising first, second and third members.
Figure 15:
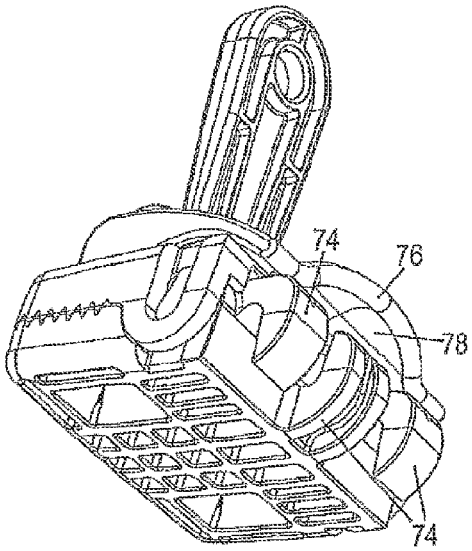
Figure 19:
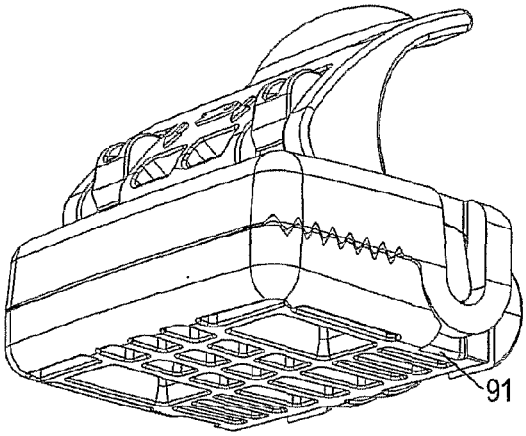
Figure 20:
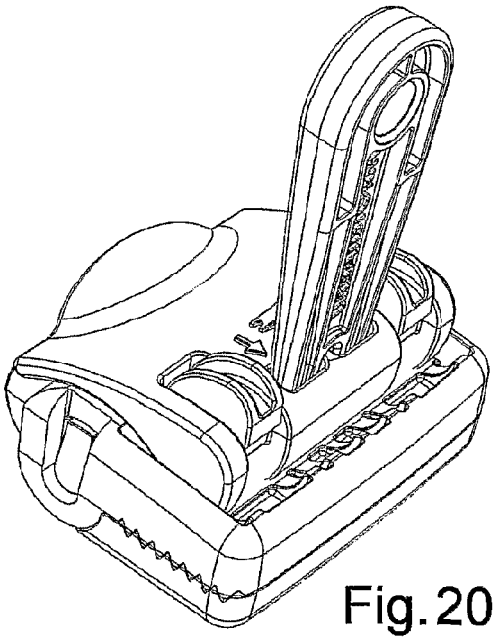
Figure 21:
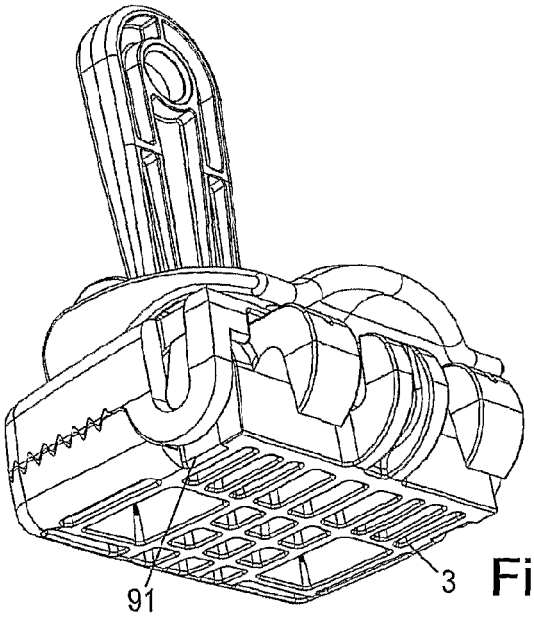
Figure 22:
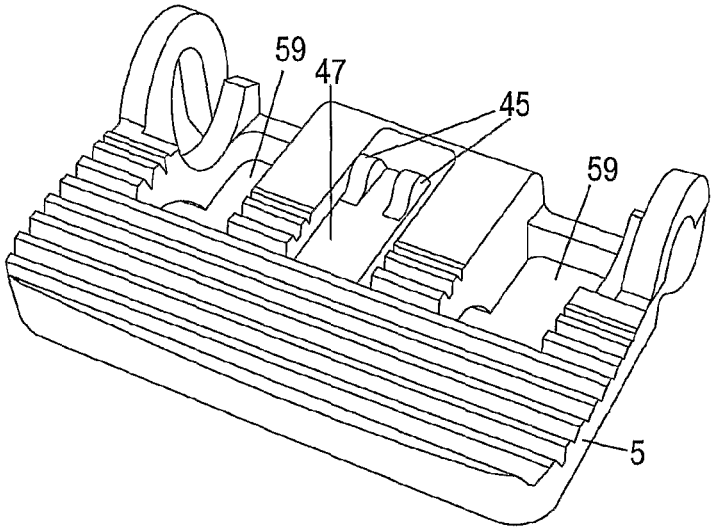
FIGS. 22, 23 and 28 show the second member of the embodiment of FIG. 14 in isolation from the first and third members.

Extending away from the main body of the third member 70, in the opposite direction to the convex lip 76, is a set of camming portions 53. The profile of those camming portions is chosen such that the closure of the third member 70, from an open position, as shown in FIG. 19, to a closed position, as shown in FIG. 14, will close the jaw 72 to the desired extent; a bigger cam, i.e. a larger camming height h relative to the axis 55 of the hinge pins 51 (see FIG. 25) will close the jaw 72 more than a cam with a shorter height.

The shape of the cam is also designed such that it will go over-centre upon pressing into its closed position. This is to prevent the third member from accidentally opening again.

Figure 40:
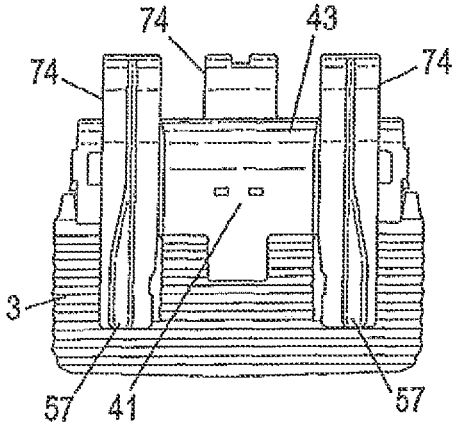
Figure 41:
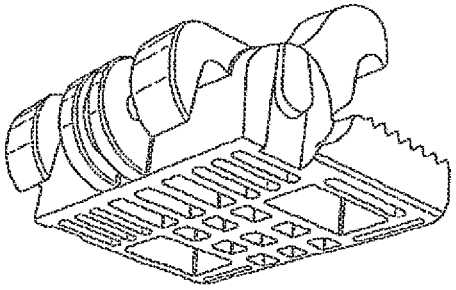

Referring next to FIGS. 39, 40 and 41, two of the posts 57 are provided on the first member 3. They extending upwardly from the first member 3. Those two posts 57, when assembling the clamp 1, pass through two holes 59 that are provided in the second member 5. They then extend above that second member 5 for attachment to the third member 70.

The posts 57 have hooks at their ends that define a groove for receiving the hinge pins 51 of the third member 70. Therefore, to finish an assembly of a clamp 1, after insertion of the posts 57 through the holes 59 in the second member 5, the third member 70 is engaged onto the hooks 49 on the ends of the posts 57 with the camming portions 53 (including a central hub 80 and two outside portions—see FIG. 24) resting on an upper surface of the second member 5.

The two outside portions of the camming portion 53 are located outside of the two hinge pins 51. The central hub 80 is located between the two hinge pins 51.

The upper surface of the second portion 5 against which the caroming portion 53 bears is defined by a wide, curved, groove 63. See FIG. 23. That curved groove 63 provides the bearing surface against which the camming portion 53 pushes for closing the jaw 72 as the third member 70 is rotated about its axis, as defined by the hinge pins 51 within the hooks 49 of the posts 57, towards its closed position.

The second member additionally comprises a resilient tongue 47. In this embodiment it is located between the two holes 59. The resilient tongue 47 is provided for biasing the jaw 72 into an open configuration until the third member 70 is used to clamp the jaw 72 shut. The tongue 47 has two raised areas 45, although one will be enough, if needed at all. The raised areas are adapted to bear against a flat area 41 provided towards the middle of the first member 3, near its back. See FIG. 40.

A curved area 43 is also provided further towards the rear of that member. That curved area 43 is adapted to accommodate the rear of the second member 5, as the jaw pivots. The rear of the second member, is curved correspondingly in the appropriate area. Preferably all three members 3, 5, 70 are moulded components made of a tough plastic material. Many suitable plastics are known in the art. The clamp might alternatively be made from a metal casting, or by some other well established method or material.

Typically the clamps are approximately 7 to 8 cm wide, 3 to 4 cm deep and 6 to 7 cm long. Typically the grooves in the gripping surfaces are between 1 and 2 mm deep.

Other sizes, e.g. for smaller or larger posters, could also be made.

Referring next to FIGS. 42 to 52, a further embodiment of the present invention is shown. For the most part it functions in much the same way as the embodiment of FIG. 31. For example, it has a wire 210 looping around a framework of a hoarding 208 for tensioning a poster therewithin, the poster being clamped onto the wire by a plurality of clamps 1. Further, that wire runs through a number of bearings, including corner bearing members 12 and side bearing members 10, albeit variants thereof. A fixing point 240 is illustrated, however, in the bottom right corner as shown in FIG. 52—that figure has had the wire and the corner bracket removed to illustrate the position of that fixing point 240 and the location of a corner pulley wheel 28 (affixed to the corner bracket). Other positions for the fixing point 240 might instead be used, but with this position, the wire can extend a considerable distance further around the hoarding 208 than a single loop thereof.—in this case a full length of one side thereof. This ensures that there is a full loop of wire 210 onto which clamps 1 can be mounted. Additionally a winch 44 is provided for tightening the wire 210 once the clamps are attached to a poster. The main distinction between this embodiment and that of FIG. 31, however, is the provision of a guide frame 250.

Figure 42:
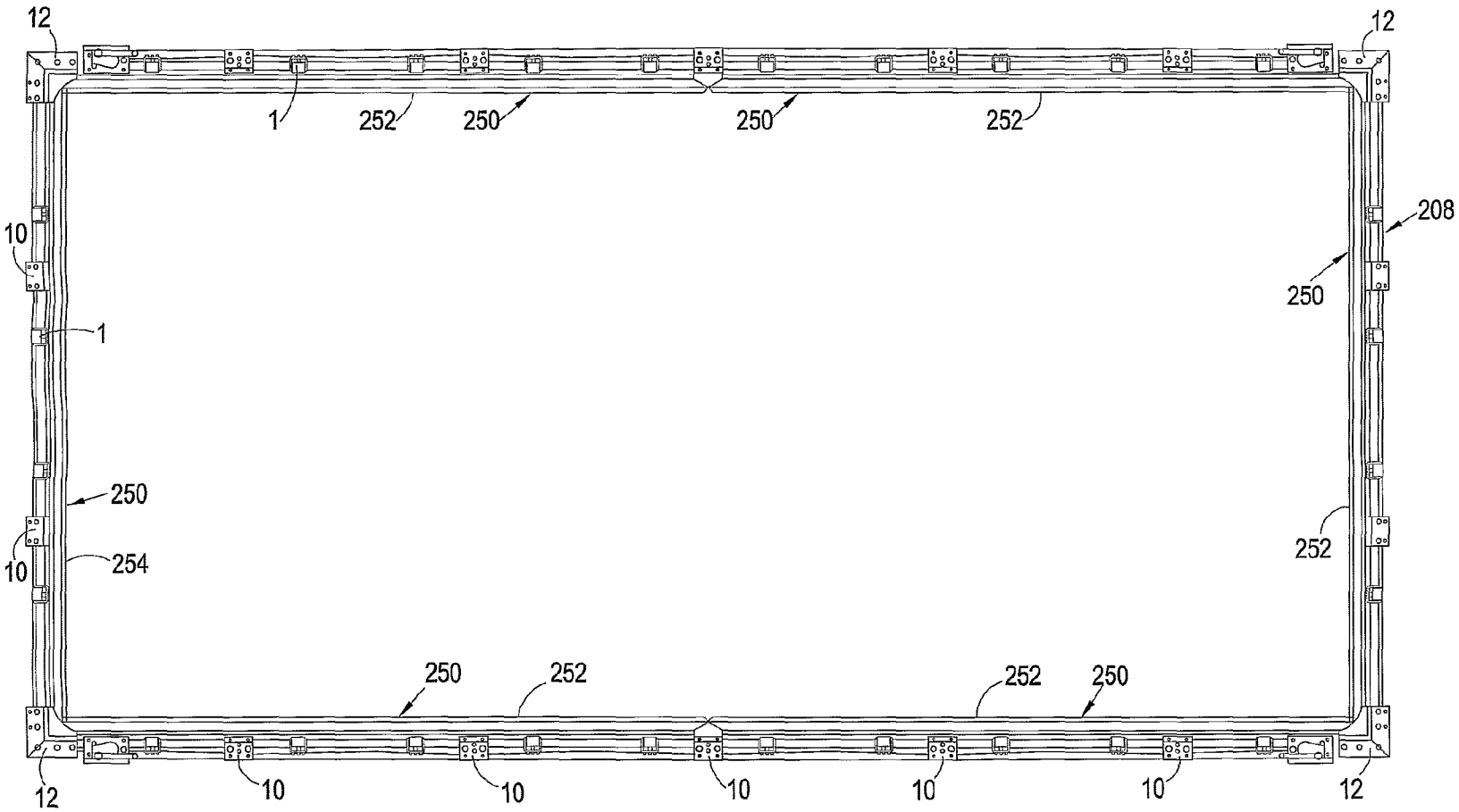
FIG. 42 shows a plan view of a further embodiment of poster mounting system in accordance with the present invention.
Figure 43:
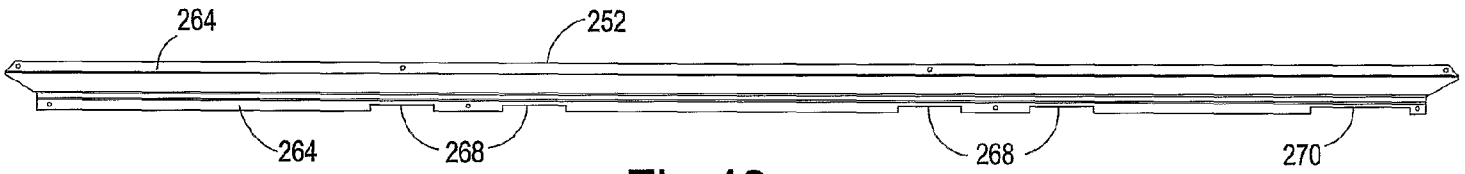
FIGS. 43 to 46 show a preferred horizontal guide frame member forming a part of the poster mounting system of FIG. 42.
Figure 44:
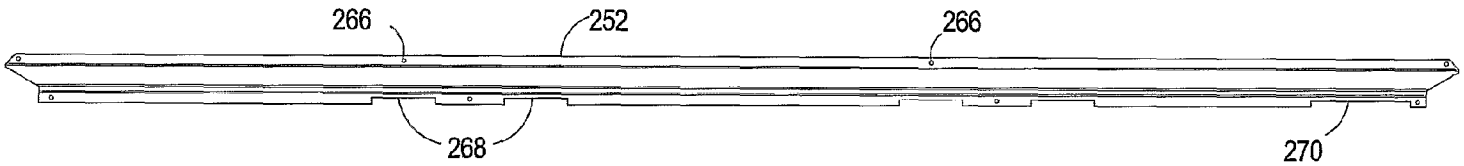
Figure 46:
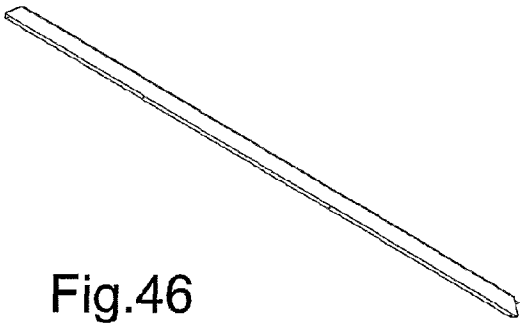
Figure 45:
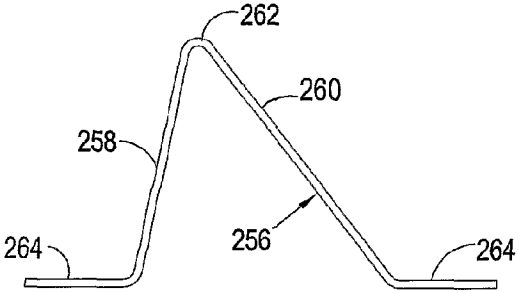
Figure 47:
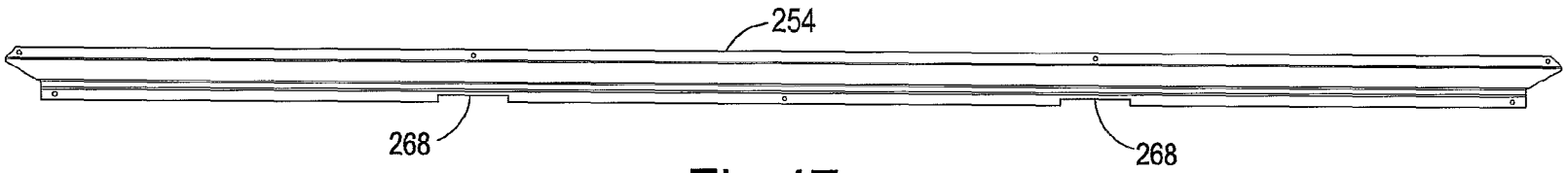
FIGS. 47 to 49 show a preferred vertical guide frame member forming a part of the poster mounting system of FIG. 42.
Figure 49:
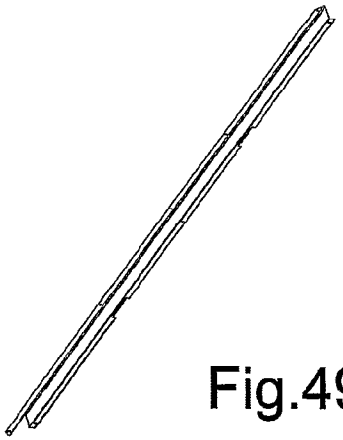
Figure 48:
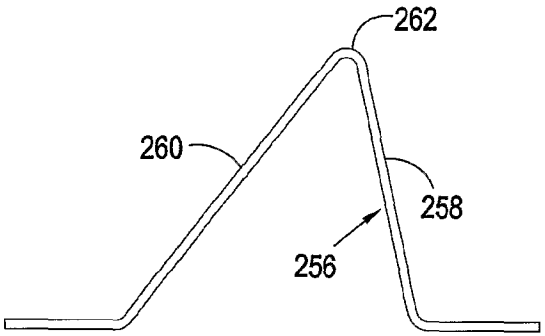
Figure 50:
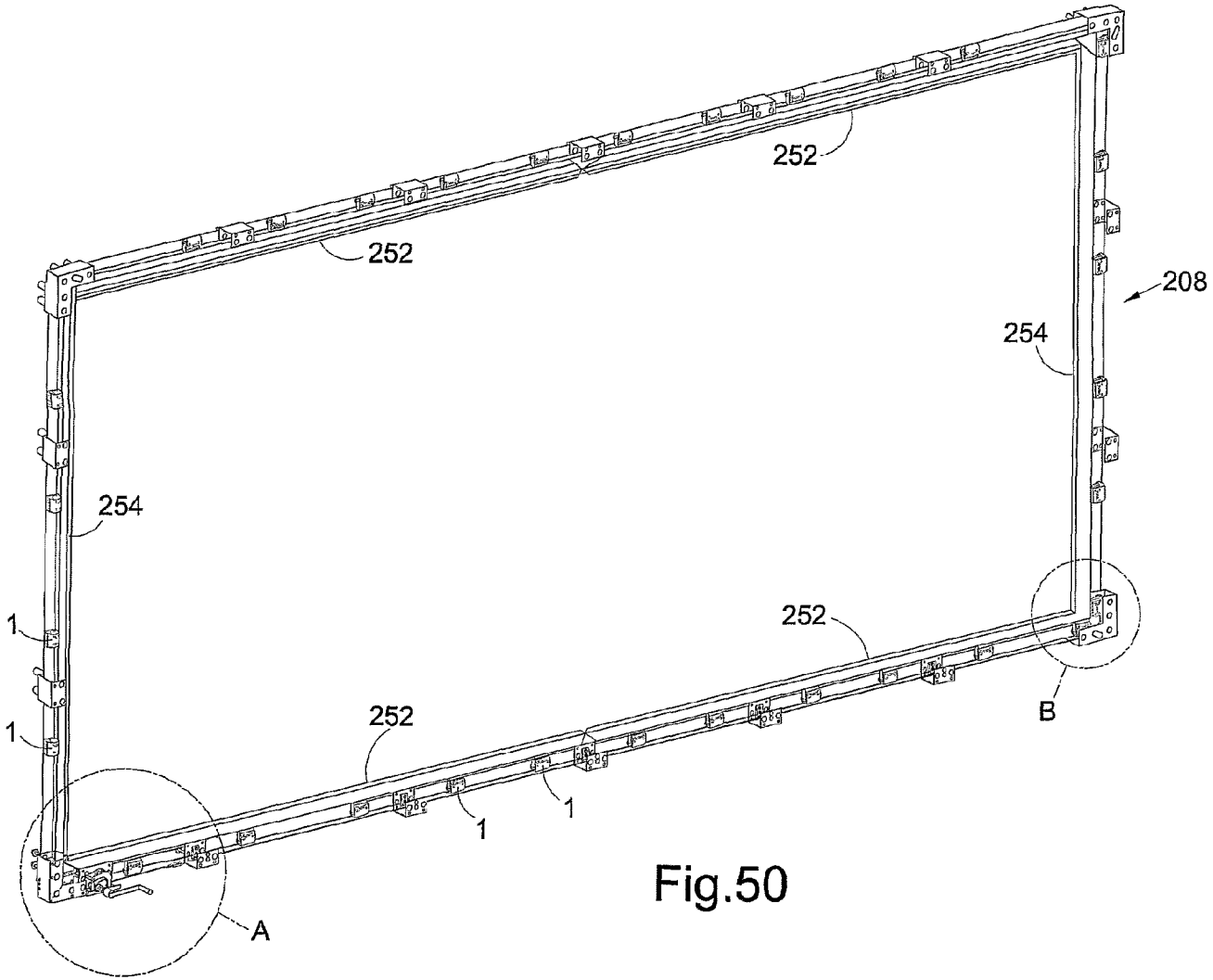
FIG. 50 shows a perspective view of the poster mounting system shown in FIG. 42.

Referring to FIGS. 42 and 50, the guide frame 250 can be seen to be formed from four horizontal guide frame members 252—two for the bottom side and two for the top side—and two vertical guide frame members 254—one for each upright side. Other numbers of frame members might be preferred, especially where the side length ratios are altered (this hoarding being approximately of a 2 by 1 length to height ratio).

The horizontal guide frame members are shown in greater detail in FIGS. 43 to 46. They have a generally constant section in the form of a single saw-tooth 256, having a shorter side 258 and a longer side 260 so as to provide an asymmetrical section. The tip 262 of the saw-tooth 256, however, is rounded since in use, or at least while mounting a poster into a hoarding, the poster will rub or slide over the tip of it.

To the sides of the saw-tooth, flanges 264 extend parallel and in plane relative to one another. They define are for attaching the horizontal guide frame members to the back of the hoarding, e.g. with screws. For that purpose, holes 266 are provided.

The substantially constant cross section is interrupted intermittently along the length of the horizontal guide frame members 252 by cut-outs 268 in the flanges 264. Those cut outs are located for receiving brackets of the pulleys or the like around the perimeter of the hoarding, as shown in FIGS. 42 and 50. As a result, the guide frame members can sit flat against the back of the hoarding, and the brackets can likewise by mounted as close as possible to them, while still also being flat on the back of the hoarding (i.e. rather than overlapping those flanges 264. This is beneficial since the guide frame function most efficiently when their tips together all form a single flat plane, as will become readily apparent below.

It is preferred that all horizontal guide frame members are made to the same dimensions and shapes for reducing costs. However, it is possible to make left and right hand members to be mirror images of one another. As illustrated, however, they all have the same shape.

One of the cut outs is a longer cut-out 270. It is for mounting next to the winch member 44, by being a longer cut out, the cut-out 270 can more easily accommodate the larger bracket of that winch member 44.

Regarding the vertical guide frame members 254, they have a substantially identical construction to the horizontal guide frame members 252, although fewer cut-outs are needed in the illustrated embodiment since they are more readily reversible, given that they singularly extend along the sides of the hoarding (the locations of the side brackets around the hoarding are usually evenly spaced along all sides of the hoarding, but that generally prevents them from being symmetrically centred relative to the guide frame members where more than one guide frame member is used along a particular side—the additional cut-outs provide for reversibility (i.e. left hand side or right hand side mountability, top or bottom). Further, the longer cut out 270 is not needed since the winch 44 is mounted at the bottom of the frame for easy accessibility by a poster fitter. Nevertheless, in view of the similarities, like reference signs have been added to the drawings.

The pitch direction of the saw-tooth 256 is illustrated to be reversed relative to the horizontal guide frame members only since the direction of the section is altered—the pitch still leans outwards relative to the centre of the frame/hoarding, i.e. when the member is mounted onto the back of the hoarding.

Referring next to FIG. 51, a more detailed view of a winch assembly relative to the wire 210, the clamps 1 and the horizontal and vertical guide frame members 252,254 is shown. Due to the angle of the perspective, and due to the opposed mitre-ing of the ends of the guide frame members (for maintaining access into the corners of the hoarding behind the corner bracket 12) the section of the guide frame members is difficult to envision. However, the tips 262 of the hinge frame members 252, 254 locate out of the plane of the loop of wire 210 cut-out—away from the back of the hoarding.

By having those tips define a plane that is spaced further from the back of the hoarding than the loop of wire 210, as a poster is taughtened across that frame by means of tightening the wire (with the clamps clamped onto the edges of a poster), that poster will take on a very flat finish across the opening within the multiple frame members 252, 254. This finish for the visible part of the poster, therefore will be superior (or certainly not inferior) to the finish achieved without the frame 250.

Finally, referring again to FIG. 51, it can be seen that the handle 222 for the winch 44 is removable. The handle has a socket 224 on its end for turning a nut 226 on the winch 44. That nut can reside behind (or whining) a hole provided in the outer frame of the hoarding (not shown). That nut can therefore be accessed with the handle, but it won't be immediately visible by an observer of the poster. The outer frame of the hoarding can therefore conceal the entire working mechanisms of the poster mounting system, with a very flat visible part of the poster being located within the opening of the outer frame of that hoarding.

The present invention has been described above purely by way of example. Various omissions, modifications and additions may be made without departing from the scope of the invention as defined in the claims.

The invention claimed is:

1. A poster clamp comprising:

first and second members, the members comprising first and second gripping surfaces, respectively, for gripping opposing sides of a poster near an edge of the poster, the first and second members being pivotable relative to one another about a first pivot axis for making the two gripping surfaces grip the poster, a third member, pivotally mounted onto the first member about a second pivot axis, and having a camming surface or surfaces spaced from the second pivot axis by a varying radius, the third member thus defining a cam for bearing against an opposing surface of the second member opposite the second gripping surface of the second member, the third member and cam being rotatable relative to the first and second members for selectively biasing the cam against the opposing surface of the second member to pivot the first and second members together so as to move the two gripping surfaces together, an end part of the rotation of the third member into a final clamping position being an over-centre movement for the cam, and each gripping surface for gripping a poster comprises a plurality of grooves, the first and second gripping surfaces intermeshing upon clamping the two gripping surfaces together, whereby, upon compressing the two gripping surfaces onto a poster, the poster will be caused to at least partially deflect into the grooves, wherein the grooves extend generally parallel to one another from one side of the clamp to another side of the clamp, and thus in use being generally parallel to the edge of the poster being gripped by the poster clamp, wherein one or more posts extend up from the first member through one or more holes in the second member for pivotally mounting the third member about the second pivot axis and positioning the second pivot axis overlying the first and second gripping surfaces so that the second gripping surface is located between the first gripping surface and the second pivot axis.

2. A clamp according to claim 1, further comprising a resilient tongue to bias the two gripping surfaces apart.

3. A clamp according to claim 1 comprising the third member having one or more hinge pins for securing or latching or hooking onto the one or more posts and for forming the second pivot axis.

4. A clamp according to claim 1, wherein the clamp has an end for engaging a wire and three or more hooks extend from the end of the clamp for engaging the wire, at least two of the hooks facing different directions.

5. The clamp of claim 4, wherein the hooks define a gap through or behind or between them, and the hooks are aligned such that a straight wire can freely slide through the gap.

6. The clamp of claim 1, wherein the one or more posts extend up from the first member at an incline for positioning the second pivot axis over the first and second gripping portions.

7. A clamp according to claim 1, wherein the first pivot axis is formed by pairs of apertures and pivot axles in the first and second members.

8. The clamp of claim 7, wherein the axles or apertures have a ramp feature to facilitate assembly of the two components.

9. The clamp of claim 7, wherein the apertures are elongated to allow a hinge point between the first and second members to float within the aperture to allow a wider range of poster thicknesses to be accommodated while still maintaining the gripping surfaces parallel to one another.

10. The clamp of claim 1, comprising a hole or recess for receiving an end of a clamp release device for prising open the clamp, wherein the hole or recess is located at an underside of a lip in a free end of the third member, whereby a tool or finger can get a purchase on the third member.

11. A poster mounting system, the system including a wire forming a loop of adjustable tension, and a plurality of poster clamps according to claim 1, the clamps being releasably attachable to the loop and to the poster, the clamps being retained on the wire on tightening of the wire in the loop.

12. The system of claim 11, wherein the clamps are attached to the wire and wherein the clamps are clamping respective edges of the poster.

13. A poster mounted in a poster mounting system according to claim 11.

14. A poster for mounting in a poster mounting system according to claim 11, cut to dimensions of about 6068 mm by 3120 mm, about 6100 mm by 1050 mm or about 6100 mm by 3050 mm.

15. A poster mounting system comprising a loop of wire incorporated into or onto a poster hoarding, wherein a poster to be displayed can be attached to the wire, using clamps that engage the edges of the poster, the clamps being attachable to the loop without access to the ends of the loop, and the clamps being in accordance with claim 1.

16. The system of claim 15, wherein the clamps are attached to the wire and wherein the clamps are clamping respective edges of the poster.

17. A poster mounted in a poster mounting system according to claim 15.

18. A method of mounting a poster, onto or within a poster hoarding, comprising using a poster hoarding that is formed with a loop of wire around the poster hoarding, attaching a plurality of poster clamps according to claim 1 to edge regions of the poster attaching the clamps to the wire, and tightening the loop of wire, to pull the poster tight on the poster hoarding.

19. A method of mounting a poster on a poster hoarding, comprising using a poster hoarding that is formed with a loop of wire around the poster hoarding, there being a plurality of poster clamps according to claim 1 attached to the loop of wire, attaching the poster clamps to edge regions of the poster, and tightening the loop of wire to pull the poster tight on the poster hoarding.

* * * * *